US010693262B2

(12) United States Patent
Hsu

(10) Patent No.: US 10,693,262 B2
(45) **Date of Patent: *Jun. 23, 2020**

(54) SPARKLESS SOCKET

(71) Applicant: ELIFECONNECTION CO., LTD., Taipei OT (TW)

(72) Inventor: Cheng-Tsuen Hsu, Taipei (TW)

(73) Assignee: ELIFECONNECTION CO., LTD., Taipei (TW)

( * ) Notice: Subject to any disclaimer, the term of this patent is extended or adjusted under 35 U.S.C. 154(b) by 42 days.

This patent is subject to a terminal disclaimer.

(21) Appl. No.: 15/065,887

(22) Filed: Mar. 10, 2016

(65) Prior Publication Data

US 2016/0294126 A1 Oct. 6, 2016

Related U.S. Application Data

(63) Continuation-in-part of application No. 14/753,013, filed on Jun. 29, 2015.

(30) Foreign Application Priority Data

Apr. 1, 2015 (TW) ..... 104110702 A
Oct. 13, 2015 (TW) ..... 104133442 A

(51) Int. Cl.
*H01H 73/00* (2006.01)
*H01R 13/66* (2006.01)
(Continued)

(52) U.S. Cl.
CPC ..... *H01R 13/6683* (2013.01); *H01R 13/7038* (2013.01); *H01R 13/7035* (2013.01); *H01R 25/003* (2013.01)

(58) Field of Classification Search
CPC ..... H01R 13/7036; H01R 13/6683
(Continued)

(56) References Cited

U.S. PATENT DOCUMENTS 4,034,172 A * 7/1977 Glover ..... H01R 13/703 200/51.1
5,910,875 A * 6/1999 Tian ..... H02J 13/0048 361/1
(Continued)

FOREIGN PATENT DOCUMENTS

CN 201741874 2/2011
CN 102035098 4/2013
(Continued)

OTHER PUBLICATIONS

"Office Action of Taiwan Counterpart Application", dated Jul. 5, 2016, p. 1-p. 5, in which the listed references were cited.
(Continued)

*Primary Examiner* — Thienvu V Tran
*Assistant Examiner* — Lucy M Thomas
(74) *Attorney, Agent, or Firm* — JCIPRNET

(57) ABSTRACT

A sparkless socket including a socket, a sensing module, a controller, a switching module, a pressing stick and a mechanical switch is provided. The sensing module includes an emitter and a receiver. The receiver receives an infrared light emitted by the emitter through a light guide element module and holes on slots of the socket and generates a sensing result accordingly. The pressing stick is pressed by a plug if the plug is plugged into the socket. The mechanical switch is controlled by the pressing stick to generate a first signal. The switching module is controlled by the controller to transmit an AC power provided by a city power system from the controller to the socket. The controller determines whether the plug is plugged into the socket according to the sensing result and the first signal and thereby enables or disables the switching module.

18 Claims, 27 Drawing Sheets

(51) Int. Cl.
*H01R 13/703* (2006.01)
*H01R 25/00* (2006.01)

(58) Field of Classification Search
USPC ..... 439/310, 372; 438/181, 189; 361/2, 42, 361/115
See application file for complete search history.

(56) References Cited

U.S. PATENT DOCUMENTS

| | | | | |
|---|---|---|---|---|
| 6,081,123 | A * | 6/2000 | Kasbarian | H02J 13/0048 324/521 |
| 6,181,077 | B1 | 1/2001 | Greenland | |
| 6,552,888 | B2 * | 4/2003 | Weinberger | H01R 13/713 307/125 |
| 2009/0098754 | A1 * | 4/2009 | Li | H01R 13/7038 439/93 |
| 2010/0105226 | A1 | 4/2010 | Gong et al. | |
| 2012/0291896 | A1 | 11/2012 | Shade | |
| 2013/0127261 | A1 | 5/2013 | Kagawa et al. | |
| 2014/0199863 | A1 | 7/2014 | Lin | |
| 2015/0253796 | A1 | 9/2015 | Hsu | |

FOREIGN PATENT DOCUMENTS

| | | |
|---|---|---|
| CN | 103053083 | 4/2013 |
| CN | 203799201 | 8/2014 |
| CN | 106159578 | 11/2016 |
| FR | 2653944 | 5/1991 |
| JP | H02138877 | 11/1990 |
| JP | 2009093054 | 4/2009 |
| JP | 2012064419 | 3/2012 |
| JP | 2013134927 | 7/2013 |
| TW | 527756 | 4/2003 |
| TW | M501660 | 5/2015 |
| WO | 0041275 | 7/2000 |

OTHER PUBLICATIONS

"Office Action of Japan Counterpart Application", dated Feb. 28, 2017, p. 1-p. 3, in which the listed references were cited.

"Office Action of parent U.S. Appl. No. 14/753,013", dated Mar. 2, 2017, p. 1-p. 16, in which the listed references were cited.

"Office Action of Europe Counterpart Application," dated Jul. 24, 2017, p. 1-p. 11, in which the listed references were cited.

"Search report of Europe Counterpart Application", dated Aug. 9, 2016, p. 1-p. 11, in which the listed references were cited.

"Office Action of China Counterpart Application," dated Dec. 14, 2017, p. 1-p. 9, in which the listed references were cited.

* cited by examiner

2000 , 2000'

SPARKLESS SOCKET

CROSS-REFERENCE TO RELATED APPLICATION

This application is a continuation-in-part application of and claims the priority benefit of U.S. application Ser. No. 14/753,013, filed on Jun. 29, 2015, now pending, which claims the priority benefit of Taiwan application Ser. No. 104110702, filed on Apr. 1, 2015. This application also claims the priority benefit of Taiwan application Ser. No. 104133442, filed on Oct. 13, 2015. The entirety of each of the above-mentioned patent applications is hereby incorporated by reference herein and made a part of this specification.

BACKGROUND OF THE INVENTION

Field of the Invention

The invention relates to a socket, and specifically relates to a sparkless socket.

Description of Related Art

A conventional socket structure is shown in FIG. 1 and FIG. 2. This socket structure includes a housing 1. Two parallel slots 2 and at least one base unit 3 are configured on the housing 1. Two limiting slots 4 are configured on the base unit 3. A first clip 5*a* and a second clip 5*b* made of conductive material and opposite to each other are configured on each of the limiting slots 4. The middle part of each of the first clip 5*a* and the second clip 5*b* is bent inward so that the distance between the first clip 5*a* and the second clip 5*b* decreases to form a clamped portion 5*c*. The ends of the first clip 5*a* and the second clip 5*b* away from the slot 2 are connected with each other to form an electrical terminal 6. The electrical terminal 6 is configured to connect to city power. Both of the ends of the first clip 5*a* and the second clip 5*b*, which are closer to the slot 2, form an open insertion port 7. In addition, the insertion port 7 corresponds to the slot 2.

Accordingly, the user may insert the plug 8 into the socket structure. As a result, electricity is provided to an appliance connected to the plug 8. When two parallel and plate-like pins 9 of the plug 8 are inserted into the two slots 2 of the insertion port 7 and the plug 8 is resisted by a front wall of the base unit 3, each of the pins 9 is clamped by the clamped portion 5*c* of the first clip 5*a* and the second clip 5*b* so that the electricity of the city power is conducted from the first clip 5*a* and the second clip 5*b* to the two pins 9 of the plug 8, so as to form a conducting state.

However, when the user inserts the two pins 9 of the plug 8 into the slots 2 or pulls the two pins 9 of the plug 8 from the insertion slot 7, sparks are easily generated at the moment when the two pins 9 of the plug 8 are being in contact with or being pulled out from the first clip 5*a* and the second clip 5*b*, and therefore, the generated sparks not only cause danger but also scare the user.

SUMMARY OF THE INVENTION

The invention provides a sparklers socket which can prevent sparks from being generated and causing danger at the moment when pins of a plug are being in contact with or being pulled out from conductive clips in a socket, so as to reduce user's fear and to enhance the electricity safety.

The sparkless socket of the invention is configured to insert a pair of pins of a plug. The sparkless socket includes a socket, a sensing module, a controller, and a switching module. A first slot and a second slot are configured in the socket. A through hole is configured on a slot wall of each of the first slot and the second slot, and the through holes face each other. The sensing module includes an emitter and a first receiver. The emitter is configured to emit infrared light. The first receiver is configured to receive the infrared light via a light guide element module and at least one of the through holes so as to generate a first sensing result accordingly. The controller is coupled to the sensing module so as to receive the first sensing result, and connected to a city power system. The switching module is coupled between the socket and the controller to receive an alternating-current (AC) power provided by the city power system from the controller, and controlled by the controller to transmit the AC power to the socket. When the controller determines that the first receiver does not receive the infrared light according to the first sensing result, the controller enables the switching module, and otherwise, the controller disables the switching module.

In one embodiment of the invention, the socket further includes a front wall, wherein the front wall has an aperture. The aperture is located between the first slot and the second slot. The sparkless socket further includes a pressing stick and a mechanical switch. The pressing stick is disposed in an inner space of the socket. An end of the pressing stick protrudes from the socket via the aperture of the front wall so as to form a protrusion part. The mechanical switch has a control terminal, and the control terminal of the mechanical switch faces another end of the pressing stick. The mechanical switch is controlled by the pressing stick so as to generate a first signal. The controller is further coupled to the mechanical switch so as to receive the first signal. When the controller determines that the first receiver does not receive the infrared light according to the first sensing result and determines that the another end of the pressing stick presses the control terminal of the mechanical switch according to the first signal, the controller enables the switching module, and otherwise, the controller disables the switching module.

In one embodiment of the invention, the another end of the pressing stick is not in contact with the control terminal of the mechanical switch when the plug does not touch the protrusion part. The plug presses the protrusion part to cause the another end of the pressing stick to press the control terminal of the mechanical switch after the pair of pins of the plug are completely inserted into the first slot and the second slot of the socket.

In one embodiment of the invention, the sensing module further includes a second receiver. The second receiver is configured to receive the infrared light via the light guide element module and one of the through holes, so as to generate a second sensing result accordingly. The first receiver is configured to receive the infrared light via the light guide element module and another one of the through holes, so as to generate the first sensing result accordingly. When the controller determines that none of the first receiver and the second receiver receives the infrared light according to the first sensing result and the second sensing result, the controller enables the switching module; otherwise, the controller disables the switching module.

In one embodiment of the invention, the socket further includes a front wall, wherein the front wall has an aperture. The aperture is located between the first slot and the second slot. The sparkless socket further includes a pressing stick and a mechanical switch. The pressing stick is disposed in an inner space of the socket. An end of the pressing stick protrudes from the socket via the aperture of the front wall so as to form a protrusion part. The mechanical switch has a control terminal, and the control terminal of the mechanical switch faces another end of the pressing stick. The mechanical switch is controlled by the pressing stick so as to generate a first signal. The controller is further coupled to the mechanical switch so as to receive the first signal. When the controller determines that none of the first receiver and the second receiver receives the infrared light according to the first sensing result and the second sensing result, and determines that the another end of the pressing stick presses the control terminal of the mechanical switch according to the first signal, the controller enables the switching module, and otherwise, the controller disables the switching module. In one embodiment of the invention, the emitter is disposed between the first receiver and the second receiver. The light guide element module includes a first light guide pillar, a second light guide pillar, and a third light guide pillar. The first light guide pillar is disposed among the first slot, the second slot, and the emitter, and configured to guide the infrared light emitted by the emitter. An entrance of the first light guide pillar faces the emitter to receive the infrared light emitted by the emitter. An exit of the first light guide pillar faces the through hole of the first slot, and another exit of the first light guide pillar faces the through hole of the second slot. The second light guide pillar is disposed between the first slot and the first receiver. An entrance of the second light guide pillar faces the through hole of the first slot, and an exit of the second light guide pillar faces the first receiver. The third light guide pillar is disposed between the second slot and the second receiver. An entrance of the third light guide pillar faces the through hole of the second slot, and an exit of the third light guide pillar faces the second receiver.

In one embodiment of the invention, when the pair of pins of the plug is not inserted or not completely inserted into the first slot and the second slot of the socket, the infrared light emitted by the emitter is transmitted to the first receiver via the first light guide pillar, the through hole of the first slot, and the second light guide pillar sequentially, and the infrared light emitted by the emitter is transmitted to the second receiver via the first light guide pillar, the through hole of the second slot, and the third light guide pillar sequentially. On the other hand, after the pair of pins of the plug is completely inserted into the first slot and the second slot of the socket, the pair of pins of the plug covers the through hole of the first slot and the through hole of the second slot to block the infrared light guided by the first light guide pillar.

In one embodiment of the invention, the light guide element module includes a first light guide pillar and a second light guide pillar. The first light guide pillar is disposed between the first slot and the emitter, and configured to guide the infrared light emitted by the emitter. An entrance of the first light guide pillar faces the emitter to receive the infrared light emitted by the emitter, and an exit of the first light guide pillar faces the through hole of the first slot. The second light guide pillar is disposed between the second slot and the first receiver. An entrance of the second light guide pillar faces the through hole of the second slot, and an exit of the second light guide pillar faces the first receiver. Wherein, the first slot and the second slot are disposed between the first light guide pillar and the second light guide pillar.

In one embodiment of the invention, when the pair of pins of the plug is not inserted or not completely inserted into the first slot and the second slot, the infrared light emitted by the emitter is transmitted to the first receiver via the first light guide pillar, the through hole of the first slot, the through hole of the second slot, and the second light guide pillar sequentially. On the other hand, after the pair of pins of the plug is completely inserted into the first slot and the second slot of the socket, the pair of pins of the plug covers the through hole of the first slot and the through hole of the second slot to block the infrared light guided by the first light guide pillar.

A sparkless socket of the invention is configured to insert three pins of a plug. The sparkless socket includes a socket, a sensing module, a controller, and a switching module. The socket includes a first slot, a second slot, and a third slot at a different direction from the first slot and the second slot. A through hole is configured on a slot wall of each of the first slot, the second slot, and the third slot. The sensing module includes an emitter, a first receiver, a second receiver, and a third receiver. The emitter is configured to emit infrared light. The first receiver is configured to receive the infrared light via a light guide element module and the through hole of the first slot, so as to generate a first sensing result accordingly. The second receiver is configured to receive the infrared light via the light guide element module and the through hole of the second slot, so as to generate a second sensing result accordingly. The third receiver is configured to receive the infrared light via the light guide element module and the through hole of the third slot, so as to generate a third sensing result accordingly. The controller is coupled to the sensing module to receive the first sensing result, the second sensing result, and the third sensing result, and connected to a city power system. The switching module is coupled between the socket and the controller to receive an alternating-current (AC) power provided by the city power system from the controller, and controlled by the controller to transmit the AC power to the socket. When the controller determines that none of the first receiver, the second receiver, and the third receiver receives the infrared light according to the first sensing result, the second sensing result, and the third sensing result, the controller enables the switching module, and otherwise, the controller disables the switching module.

In one embodiment of the invention, the socket further includes a front wall, wherein the front wall has an aperture. The aperture is located between the first slot and the second slot. The sparkless socket further includes a pressing stick and a mechanical switch. The pressing stick is disposed in an inner space of the socket. An end of the pressing stick protrudes from the socket via the aperture of the front wall so as to form a protrusion part. The mechanical switch has a control terminal, and the control terminal of the mechanical switch faces another end of the pressing stick. The mechanical switch is controlled by the pressing stick so as to generate a first signal. The controller is further coupled to the mechanical switch so as to receive the first signal. When the controller determines that none of the first receiver, the second receiver, and the third receiver receives the infrared light according to the first sensing result, the second sensing result, and the third sensing result, and determines that the another end of the pressing stick presses the control terminal of the mechanical switch according to the first signal, the controller enables the switching module, and otherwise, the controller disables the switching module.

In one embodiment of the invention, the light guide element module includes a first light guide pillar, a second light guide pillar, a third light guide pillar, and a fourth light guide pillar. The first light guide pillar is disposed among the first slot, the second slot, the third slot, and the emitter, and configured to guide the infrared light emitted by the emitter.

Wherein, an entrance of the first light guide pillar faces the emitter to receive the infrared light emitted by the emitter, and three exits of the first light guide pillar faces the through hole of the first slot, the through hole of the second slot, and the through hole of the third slot respectively. The second light guide pillar is disposed between the first slot and the first receiver. An entrance of the second light guide pillar faces the through hole of the first slot, and an exit of the second light guide pillar faces the first receiver. The third light guide pillar is disposed between the second slot and the second receiver. An entrance of the third light guide pillar faces the through hole of the second slot, and an exit of the third light guide pillar faces the second receiver. The fourth light guide pillar is disposed between the third slot and the third receiver. An entrance of the fourth light guide pillar faces the through hole of the third slot, and an exit of the fourth light guide pillar faces the third receiver.

In one embodiment of the invention, the first light guide pillar includes a first pin, a second pin, a third pin, and a fourth pin connected with each other, wherein the first pin, the second pin, the third pin, and the fourth pin form a three-dimensional double T-shaped structure. Wherein, the first pin, the second pin, and the third pin are connected with each other to form a T-shaped structure. The first pin, the second pin, and the fourth pin are connected with each other to form a T-shaped structure. In addition, the third pin and the fourth pin are connected with each other to form an inverted-L structure. Wherein, the entrance of the first light guide pillar is disposed at the fourth pin, and the three exits of the first light guide pillar are respectively disposed at the first pin, the second pin, and the third pin.

In one embodiment of the invention, when the three pins of the plug are not inserted or not completely inserted into the first slot, the second slot, and the third slot of the socket, the infrared light emitted by the emitter is transmitted to the first receiver via the first light guide pillar, the through hole of the first slot, and the second light guide pillar sequentially; the infrared light emitted by the emitter is transmitted to the second receiver via the first light guide pillar, the through hole of the second slot, and the third light guide pillar sequentially; the infrared light emitted by the emitter is transmitted to the third receiver via the first light guide pillar, the through hole of the third slot, and the fourth light guide pillar sequentially. On the other hand, after the three pins of the plug are completely inserted into the first slot, the second slot, and the third slot of the socket, the three pins of the plug cover the through hole of the first slot, the through hole of the second slot, and the through hole of the third slot to block the infrared light guided by the first light guide pillar.

Based on the above, the sparkless socket of the invention, before a plug of an appliance being completely inserted into the socket, allows the controller to disable the switching module because the infrared light emitted by the emitter may pass through the through holes and reach the receiver or another end of the pressing stick is not in contact with the mechanical switch. In contrast, after the plug of the appliance is completely inserted into the socket, the through holes are covered by the plug so that the infrared light emitted by the emitter is blocked and unable to be transmitted to the receiver and the protrusion part is controlled by the plug to make another end of the pressing stick press the mechanical switch. At this time, the controller is able to switch the switching module to be enabled, so as to provide AC power to the socket. As a result, sparks are prevented from being generated at the moment when the pins of the plug are being in contact with or being pulled out from the socket, so as to enhance the electricity safety.

In order to make the aforementioned and other features and advantages of the invention more comprehensible, embodiments accompanying figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1:
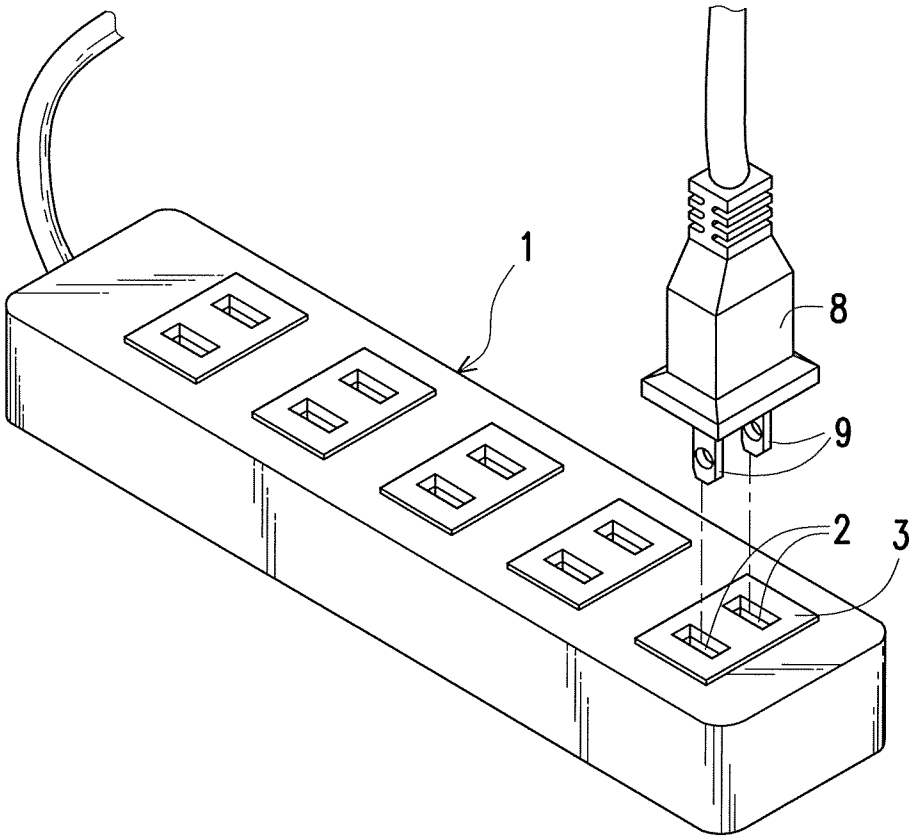
FIG. 1 is a schematic three-dimensional view of a conventional socket structure.
Figure 2:
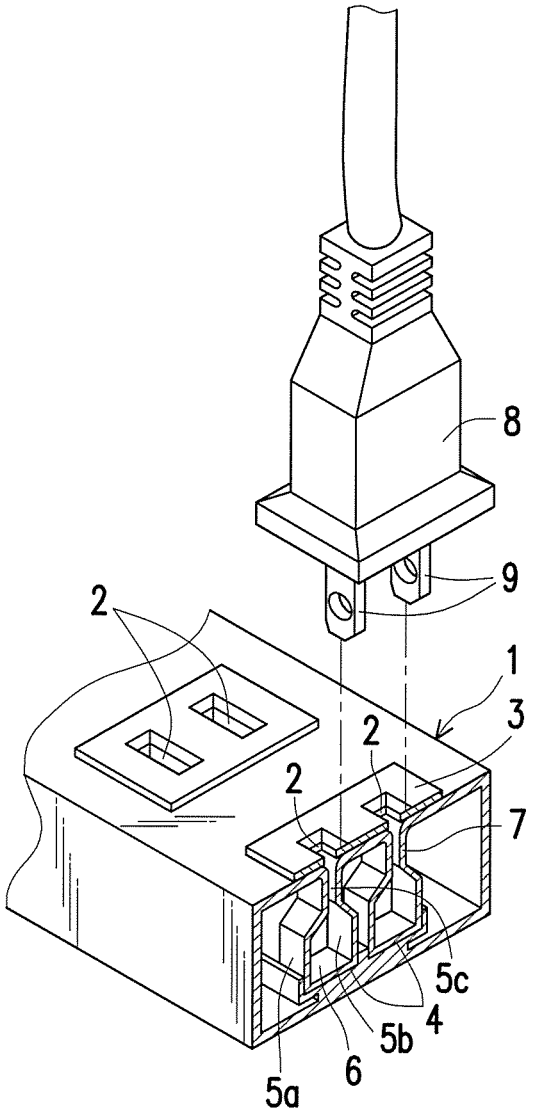
FIG. 2 is a schematic cross-sectional view of a conventional socket structure.

In order to make the present invention more comprehensible, embodiments are described below as the examples to prove that the invention can actually be realized. Moreover, wherever appropriate in the drawings and embodiments, elements/components/steps with the same reference numerals represent the same or similar parts.

Figure 5:
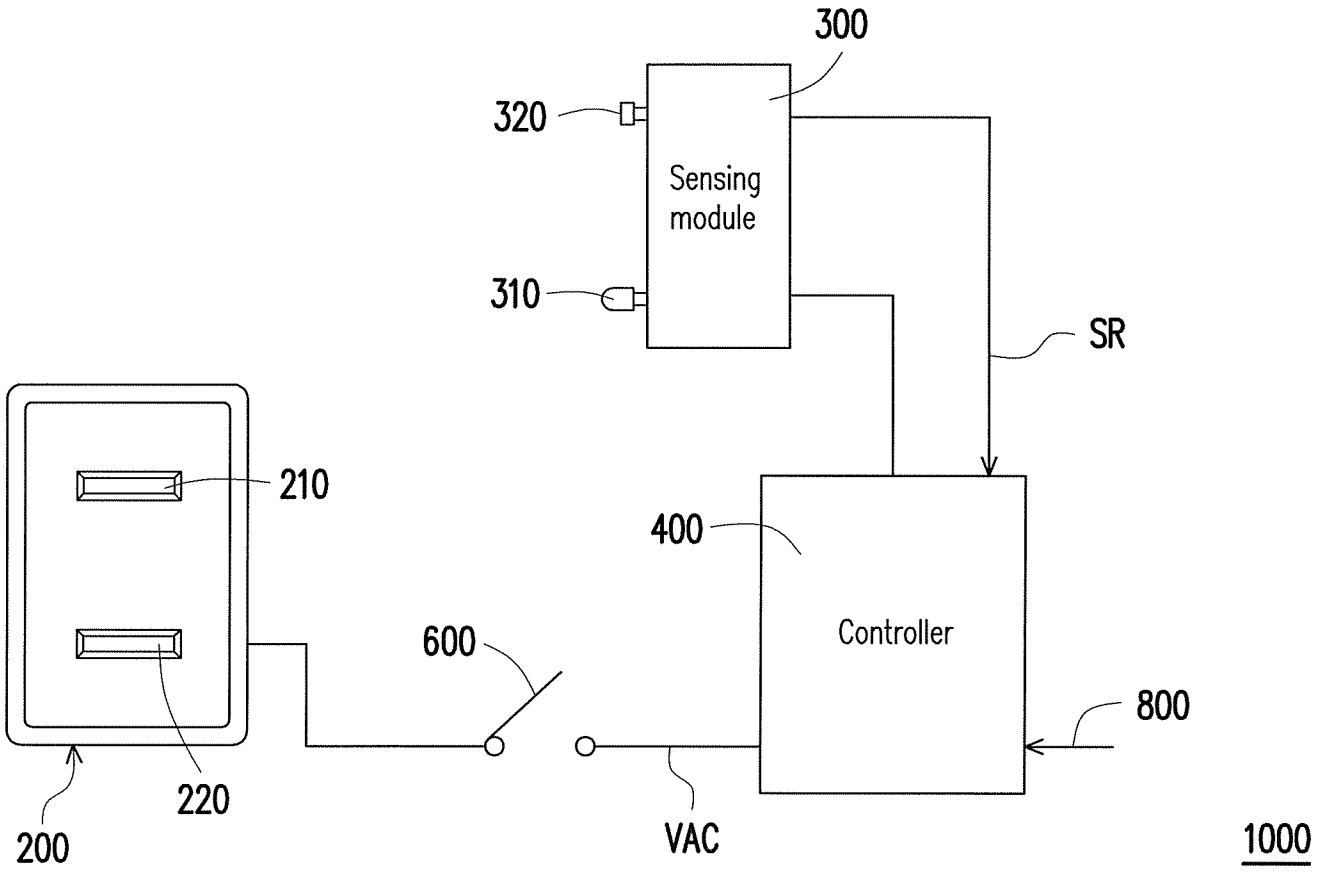
FIG. 5 is a schematic circuit diagram depicting the sparkless socket according to the first embodiment of the invention.

Referring to FIGS. 3-6, FIGS. 3-6 depict a sparkless socket 1000 according to the first embodiment of the invention. The sparkless socket 1000 is configured to insert a pair of pins 101 of a plug 100. The sparkless socket 1000 includes a socket 200, a sensing module 300, a controller 400, and a switching module 600 (as shown in FIG. 5). A first slot 210 and a second slot 220 are configured in the socket 200. A through hole 230 is configured on a slot wall of each of the first slot 210 and the second slot 220, and the through holes 230 face each other.

An emitter 310 and a first receiver 320 are configured on the sensing module 300. The emitter 310 is configured to emit infrared light 700 and transmit the infrared light 700 through the through holes 230 to the first receiver 320 via the light guide element module 500. In the present embodiment, the light guide element module 500 includes a first light guide pillar 510 and a second light guide pillar 520. The first light guide pillar 510 is disposed between the first slot 210 and the emitter 310 and configured to guide the infrared light 700 emitted by the emitter 310. An entrance port 510_1 of the first light guide pillar 510 faces the emitter 310 so as to receive the infrared light 700 emitted by the emitter 310, and an exit port 510_2 of the first light guide pillar 510 faces the through hole 230 of the first slot 210. The second light guide pillar 520 is disposed between the second slot 220 and the first receiver 320. An entrance port 520_1 of the second light guide pillar 520 faces the through hole 230 of the second slot 220, and an exit port 520_2 of the second light guide pillar 520 faces the first receiver 320. The first slot 210 and the second slot 220 are disposed between the first light guide pillar 510 and the second light guide pillar 520. Therefore, the infrared light 700 emitted by the emitter 310 may be transmitted to the first receiver 320 via the first light guide pillar 510, the through hole 230 of the first slot 210, the through hole 230 of the second slot 220, and the second light guide pillar 520. The first receiver 320 may generate a sensing result SR according to whether the infrared light 700 is received.

The controller 400 is coupled to a city power system 800 and the sensing module 300, and configured to receive the sensing result SR from the sensing module 300. The switching module 600 is coupled between the socket 200 and the controller 400. The switching module 600 receives AC power VAC provided by the city power system 800 from the controller 400, moreover, the switching module 600 is controlled by the controller 400 to transmit the AC power VAC to the socket 200. The controller 400 controls the switching module 600 to be disabled or enabled according to the sensing result SR.

Figure 3:
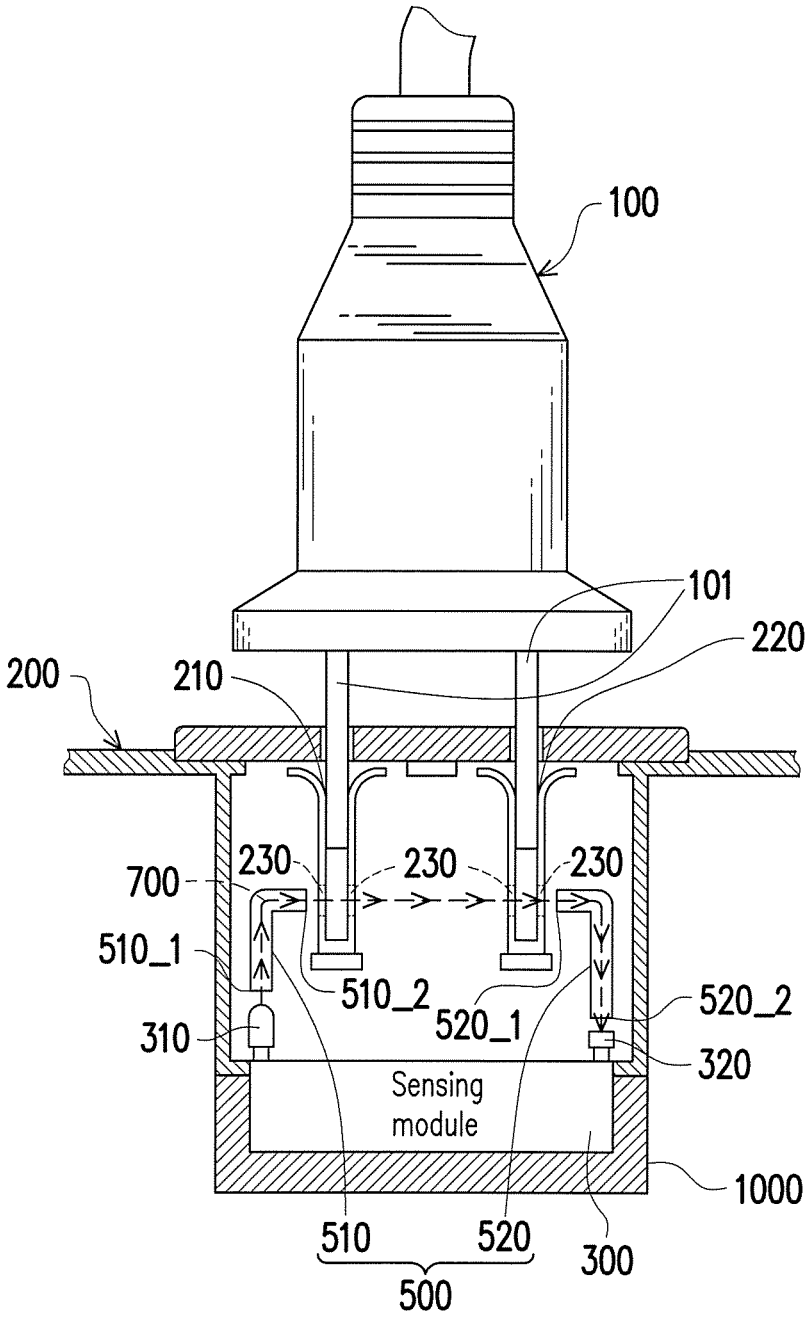
FIG. 3 is a schematic cross-sectional view depicting a sparkless socket combined with a plug according to the first embodiment of the invention.
Figure 4:
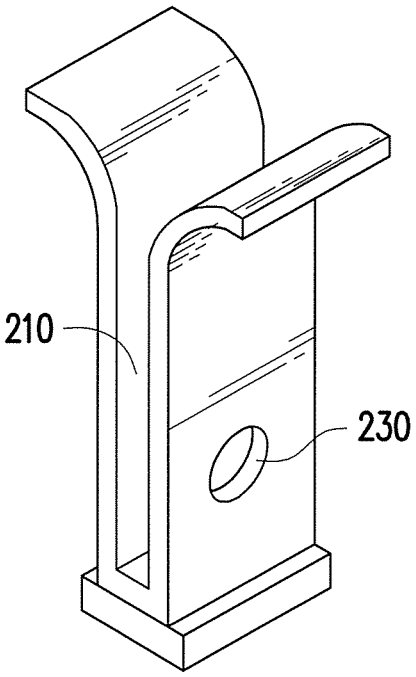
FIG. 4 is a schematic three-dimensional view depicting a first slot of the sparkless socket according to the first embodiment of the invention.

Accordingly, as shown in FIG. 3, when the pins 101 of the plug 100 are not inserted or are not completely inserted into the first slot 210 and the second slot 220 of the socket 200, the infrared light 700 emitted by the emitter 310 is transmitted to the first receiver 320 via the first light guide pillar 510, the through hole 230 on the slot wall of the first slot 210, the through hole 230 on the slot wall of the second slot 220, and the second light guide pillar 520 sequentially. When the first receiver 320 senses the infrared light 700, the sensing module 300 transmits the sensing result SR to the controller 400. At this time, the controller 400 may control the switching module 600 to be disabled so that the AC power VAC from the city power system 800 is unable to be provided to the socket 200 through the switching module 600.

Figure 6:
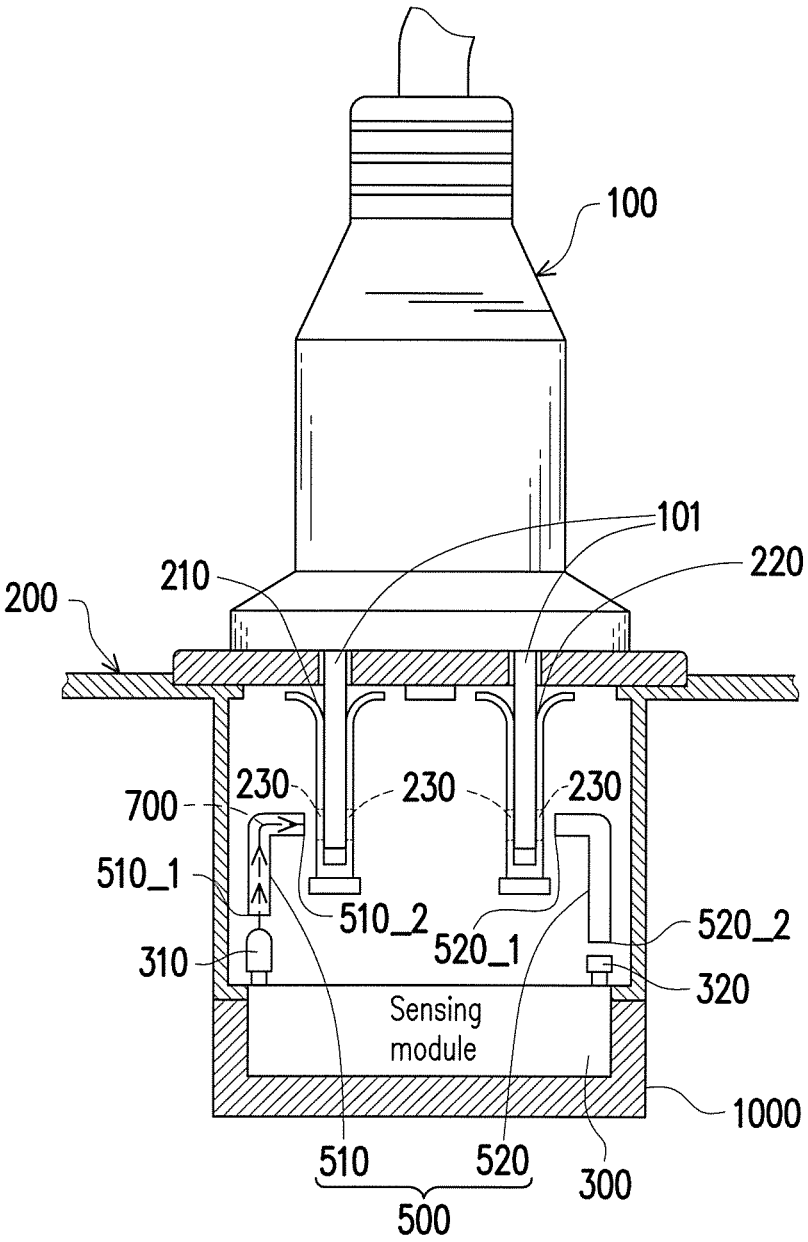
FIG. 6 is a schematic cross-sectional view depicting the sparkless socket combined with the plug according to the first embodiment of the invention.

As shown in FIG. 6, after the pins 101 of the plug 100 are completely inserted into the first slot 210 and the second slot 220 of the socket 200, the pins 101 of the plug 100 cover the through hole 230 on the slot wall of the first slot 210, thereby blocking the infrared light 700 guided by the first light guide pillar 510. As a result, the infrared light 700 is unable to reach the first receiver 320. At this time, the first receiver 320 may transmit the sensing result SR that the infrared light 700 is unable to be sensed by the first receiver 320 to the controller 400. Therefore, the controller 400 may then switch the switching module 600 to be enabled so that the AC power VAC from the city power system 800 is able to be transmitted to the socket 200 through the switching module 600, and thereby providing the required load power to the plug 100. In contrast, during power supply operation, once the plug 100 is loose and not completely inserted into the first slot 210 and the second slot 220 of the socket 200, or once the pins 101 of the plug 100 are pulled out from the first slot 210 and the second slot 220 of the socket 200, the first receiver 320 can sense the infrared light 700 (as shown in FIG. 3), and immediately the controller 400 switches the switching module 600 to be disabled (e.g. within 0.015 seconds or within 15 milliseconds). As a result, sparks are prevented from being generated between the pins 101 and the first slot 210 and the second slot 220, and therefore, from causing dangers.

Figure 8A:
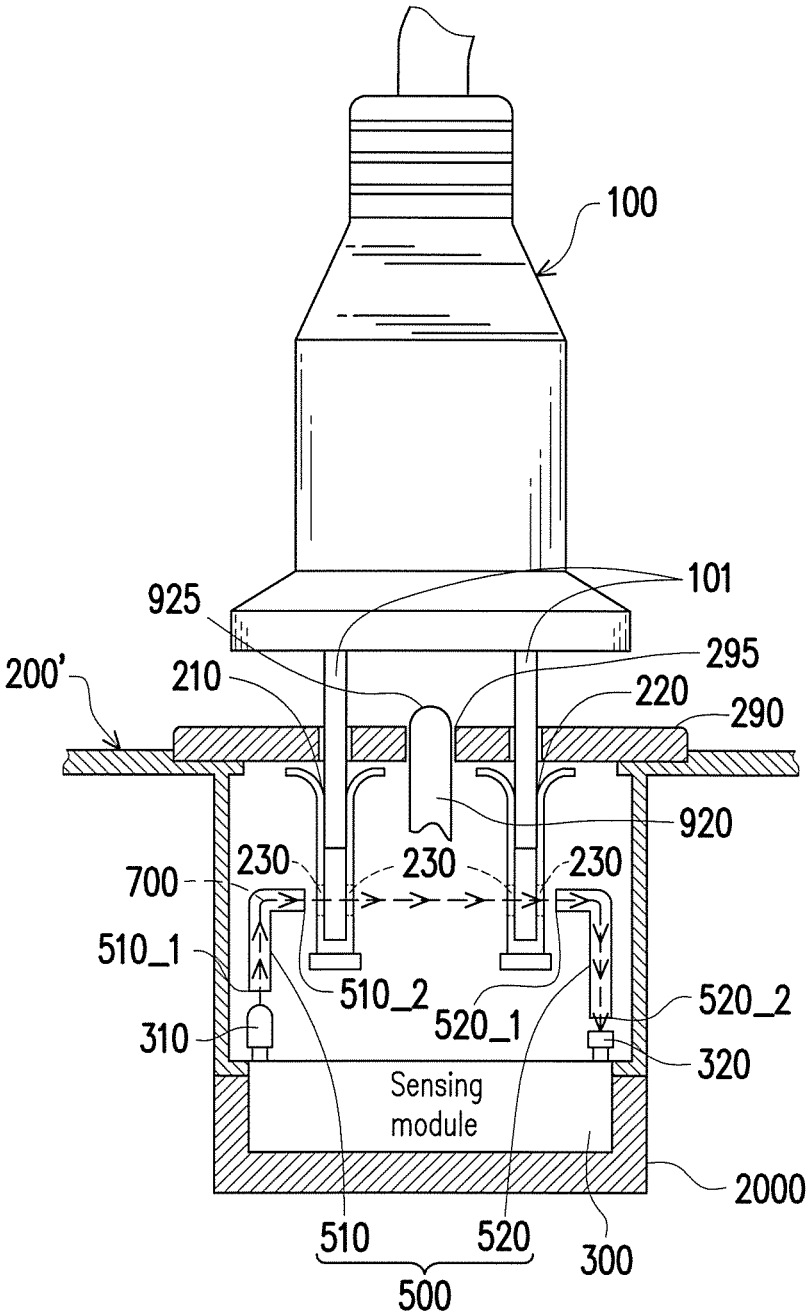
FIG. 8A is a schematic cross-sectional view depicting the sparkless socket combined with a plug along a section line A1-A2 in FIG. 7 according to the second embodiment of the invention.
Figure 8B:
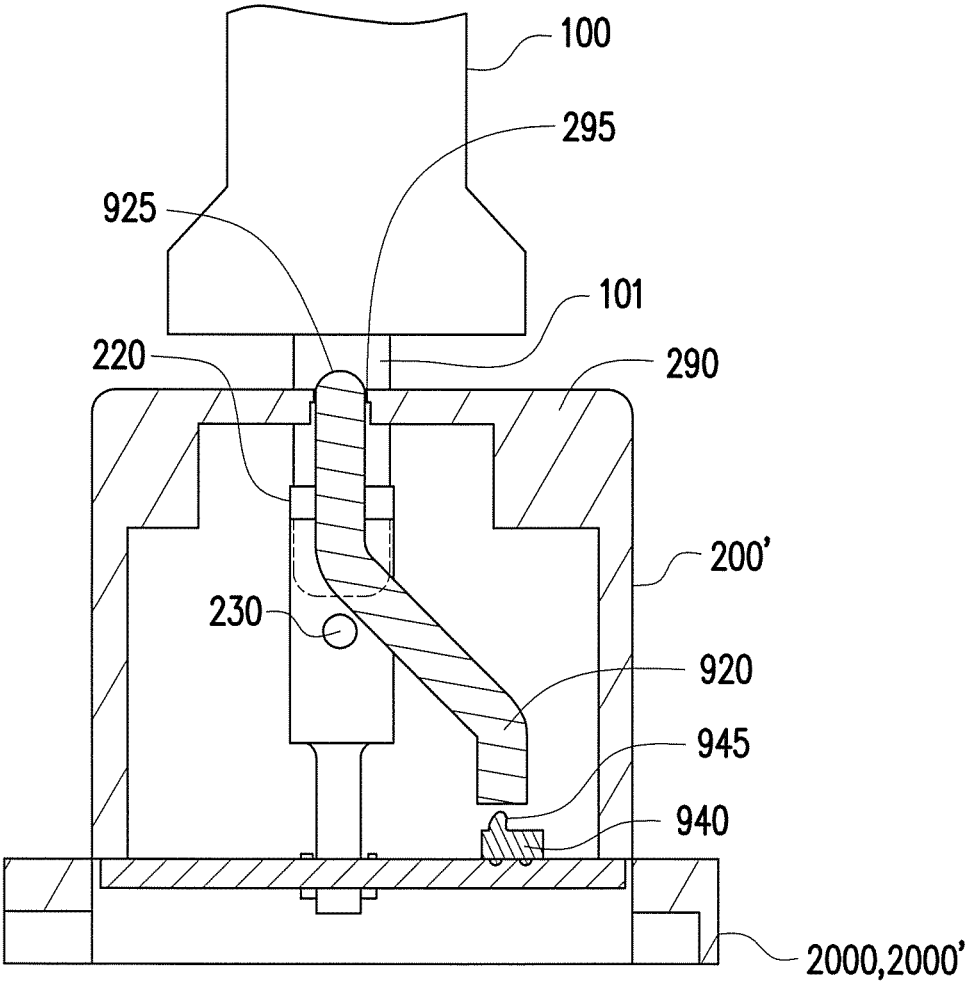
FIG. 8B is a schematic cross-sectional right view depicting the sparkless socket combined with the plug along a section line B1-B2 in FIG. 7 according to the second and the fourth embodiments of the invention.
Figure 9:
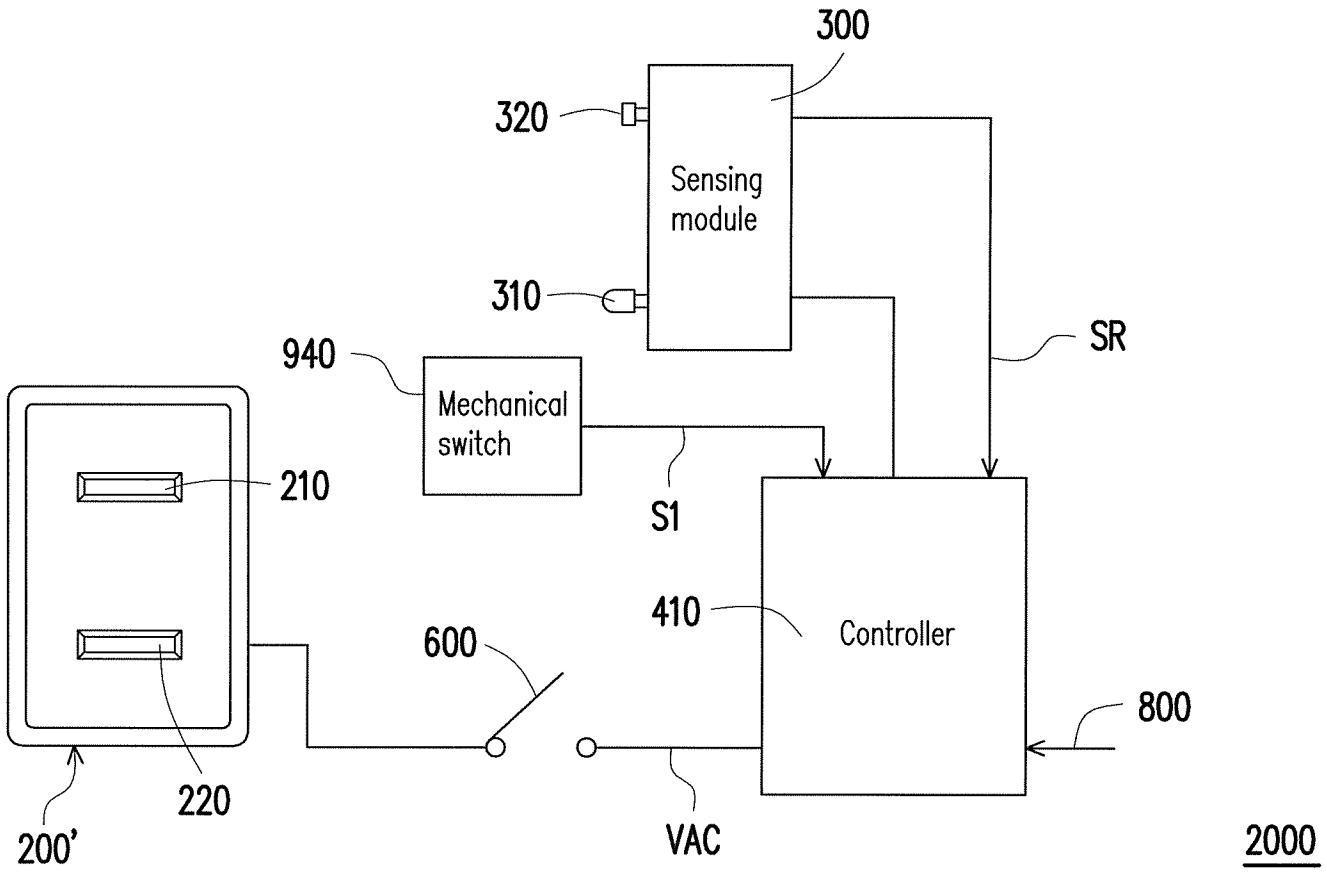
FIG. 9 is a schematic circuit diagram depicting the sparkless socket according to the second embodiment of the invention.

FIGS. 7-10B are referred to hereinafter. FIGS. 7-10B depict the sparkless socket 2000 according to the second embodiment of the invention. Similarly, the sparkless socket 2000 includes a socket 200', a sensing module 300, a controller 410, and a switching module 600 (as shown in FIG. 9). A first slot 210 and a second slot 220 are configured in the socket 200'. A through hole 230 is configured on a slot wall of each of the first slot 210 and the second slot 220, and the through holes 230 face each other. An emitter 310 and a first receiver 320 are configured on the sensing module 300. The emitter 310 is configured to emit infrared light 700 and transmit the infrared light 700 through the through holes 230 to the first receiver 320 via the light guide element module 500. The operations of the sensing module 300, the emitter 310, the first receiver 320, the light guide element module 500, and the switching module 600 of the present embodiment are respectively similar to the operations of the sensing module 300, the emitter 310, the first receiver 320, the light guide element module 500, and the switching module 600 shown in FIG. 3-FIG. 6, the details can reference to the related description above and will not be repeated.

Figure 7:
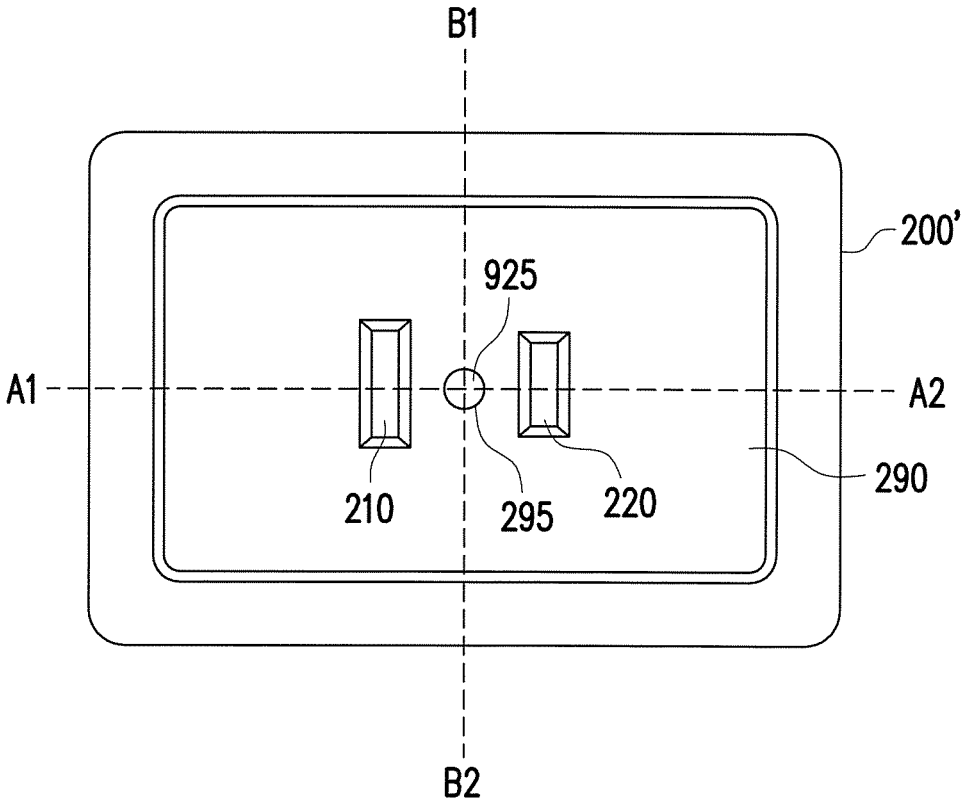
FIG. 7 is a schematic top view depicting a sparkless socket according to the second and the fourth embodiments of the invention.

In comparison with the embodiment in FIGS. 3-6, the socket 200' of the present embodiment further includes a front wall 290, wherein the front wall 290 has an aperture 295. The aperture 295 is located between the first slot 210 and the second slot 220, as shown in FIG. 7. Moreover, the sparkless socket 2000 further includes a pressing stick 920 and a mechanical switch 940, as shown in FIG. 8B or FIG. 10B. The pressing stick 920 is disposed in an inner space of the socket 200'. An end of the pressing stick 920 protrudes from the socket 200' via the aperture 295 of the front wall 290 so as to form a protrusion part 925, wherein the material of the pressing stick 920 could be insulating material, but the invention is not limited thereto. In other embodiments of the invention, if there is sufficient isolation space between the pressing stick 920 and the first slot 210 and between the pressing stick 920 and the second slot 220, the pressing stick 920 can be actualized by adopting non-insulating materials. The mechanical switch 940 has a control terminal 945. The control terminal 945 of the mechanical switch 940 faces another end of the pressing stick 920. The mechanical switch 940 is controlled by the pressing stick 920 so as to generate a first signal S1 (as shown in FIG. 8B, FIG. 9, and FIG. 10B). In one embodiment of the invention, the mechanical switch 940 may be, for example, a micro switch, wherein the control terminal 945 of the mechanical switch 940 may be, for example, a push button of the micro switch, but the invention is not limited thereto.

In comparison with the circuit structure of the sparkless socket 1000 shown in FIG. 5, the controller 410 of the sparkless socket 2000 in FIG. 9 is further coupled to the mechanical switch 940 so as to receive the first signal S1. When the controller 410 determines that the first receiver 320 does not receive the infrared light 700 according to the sensing result SR and determines that the another end of the pressing stick 920 presses the control terminal 945 of the mechanical switch 940 (as shown in FIG. 10B) according to the first signal S1, the controller 410 enables the switching module 600, and otherwise, the controller 410 disables the switching module 600. The details related to the operation that the controller 410 determines whether to enable the switching module 600 according to the sensing result SR may reference the above description of the operation of the controller 400 in FIGS. 3-6, and will not be repeated. The operations that the controller 410 determines whether to enable the switching module 600 according to the first signal S1 are described hereinafter.

As shown in FIG. 8A and FIG. 8B, when the plug 100 does not touch and does not press the protrusion part 925 (namely, the plug 100 is not completely inserted into the first slot 210 and the second slot 220 of the socket 200'), the another end of the pressing stick 920 is not in contact with the control terminal 945 of the mechanical switch 940. At this time, the controller 410 in FIG. 9 may control the switching module 600 to be disabled according to the first signal S1 (such as the first electrical level) so that the AC power VAC from the city power system 800 is unable to be provided to the socket 200' through the switching module 600.

Figure 10A:
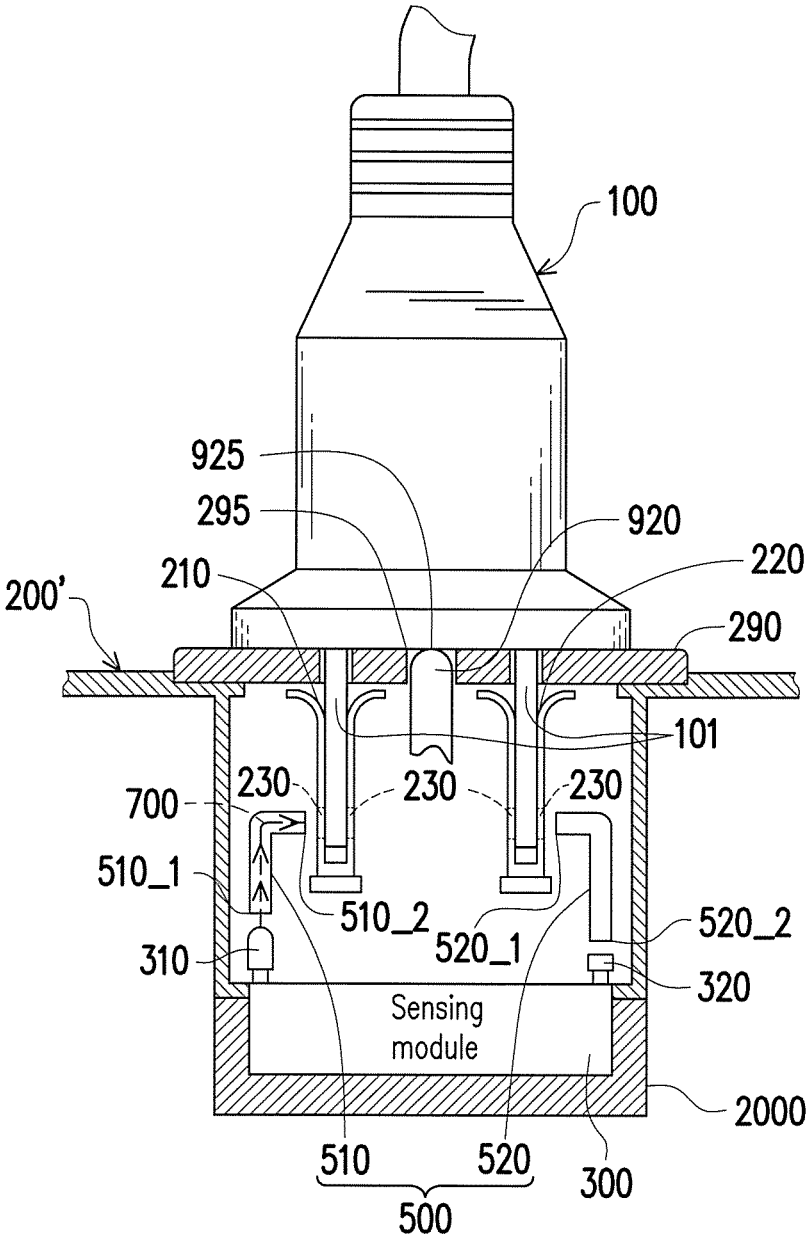
FIG. 10A is a schematic cross-sectional view depicting the sparkless socket combined with the plug along a section line A1-A2 in FIG. 7 according to the second embodiment of the invention.
Figure 10B:
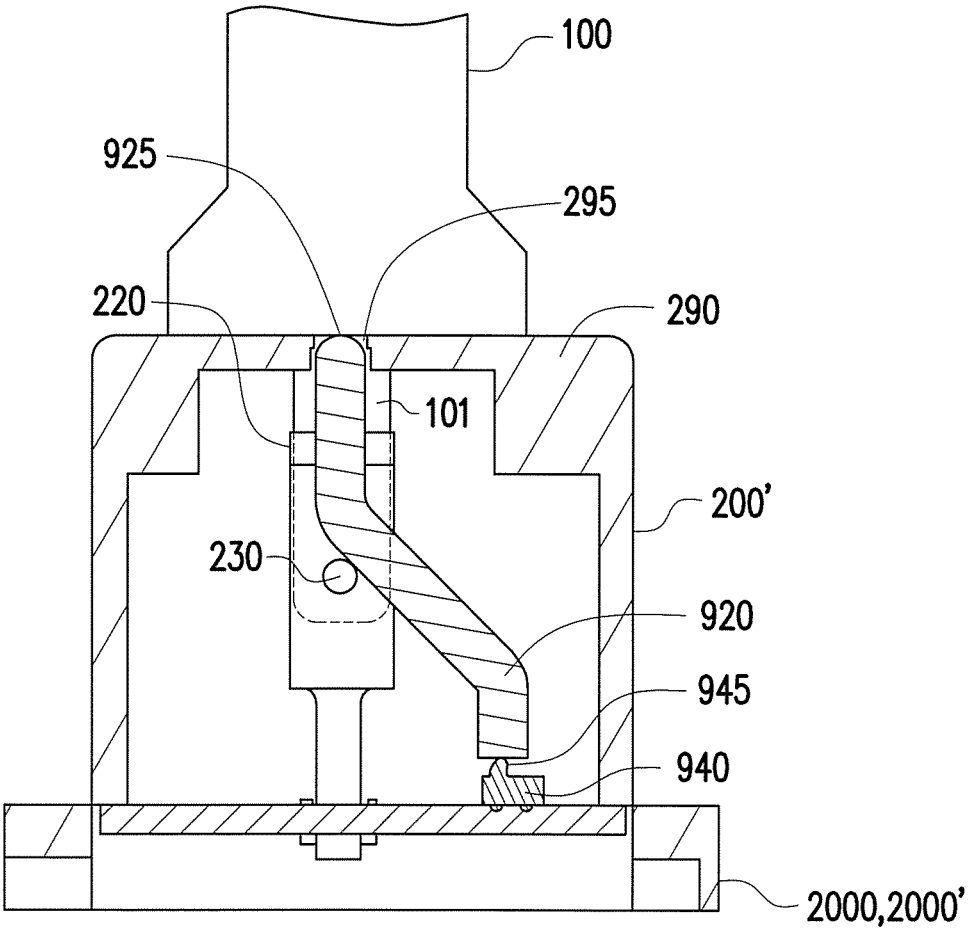
FIG. 10B is a schematic cross-sectional right view depicting the sparkless socket combined with the plug along the section line B1-B2 in FIG. 7 according to the second and the fourth embodiments of the invention.

FIG. 8A together with FIG. 8B, FIG. 10A, and FIG. 10B are referred to hereinafter. As shown in FIG. 10A and FIG. 10B, when the pins 101 of the plug 100 are completely inserted into the first slot 210 and the second slot 220 of the socket 200', the plug 100 presses the protrusion part 925 to cause the pressing stick 920 to move, so that the another end of the pressing stick 920 presses the control terminal 945 of the mechanical switch 940. As a result, the mechanical switch 940 generates the first signal S1 (such as the second electrical level) in response to the pressing action of the pressing stick 920. At this time, the controller 410 may then switch the switching module 600 to be enabled according to the first signal S1 so that the AC power VAC from the city power system 800 could be transmitted through the switching module 600 to the socket 200', and thereby providing the required load power to the plug 100. In contrast, during power supply operation, once the plug 100 is loose and not completely inserted into the first slot 210 and the second slot 220 of the socket 200', or once the pins 101 of the plug 100 are pulled out from the first slot 210 and the second slot 220 of the socket 200', the plug 100 does not press the protrusion part 925 so that the pressing stick 920 returns to the original position and the another end of the pressing stick 920 is not in contact with the control terminal 945 of the mechanical switch 940, as shown in FIG. 8A and FIG. 8B. At this time, the controller 410 may switch the switching module 600 to be disabled. As a result, sparks are prevented from being generated between the pins 101 and the first slot 210 and the second slot 220, and therefore, from causing dangers.

Generally, when the first receiver 320 is able to sense the infrared light 700 or the another end of the pressing stick 920 is not in contact with the control terminal 945 of the mechanical switch 940, it represents that the plug 100 is loose and not completely inserted into the first slot 210 and the second slot 220 of the socket 200', or the pins 101 of the plug 100 are pulled out from the first slot 210 and the second slot 220 of the socket 200'. At this time, the controller 410 may switch the switching module 600 to be disabled. As a result, sparks are prevented from being generated between the pins 101 and the first slot 210 and the second slot 220, and therefore, from causing dangers. In contrast, when the first receiver 320 is unable to sense the infrared light 700 and the another end of the pressing stick 920 presses the control terminal 945 of the mechanical switch 940, it represents that the pins 101 of the plug 100 are completely inserted into the first slot 210 and the second slot 220 of the socket 200'. At this time, the controller 410 may then switch the switching module 600 to be enabled so that the AC power VAC from the city power system 800 is able to be transmitted through the switching module 600 to the socket 200', and thereby providing the required load power to the plug 100.

Figure 11:
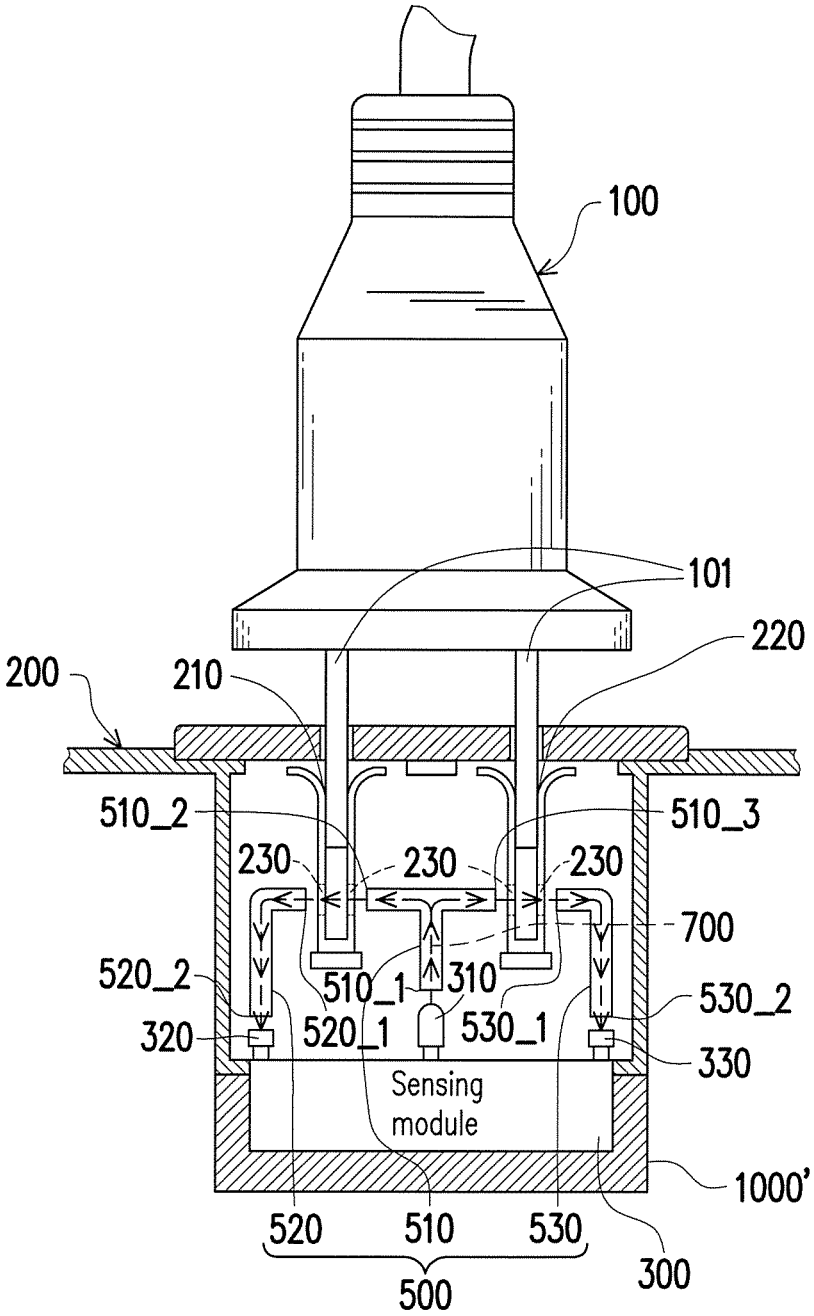
FIG. 11 is a schematic cross-sectional view depicting a sparkless socket combined with a plug according to the third embodiment of the invention.
Figure 12:
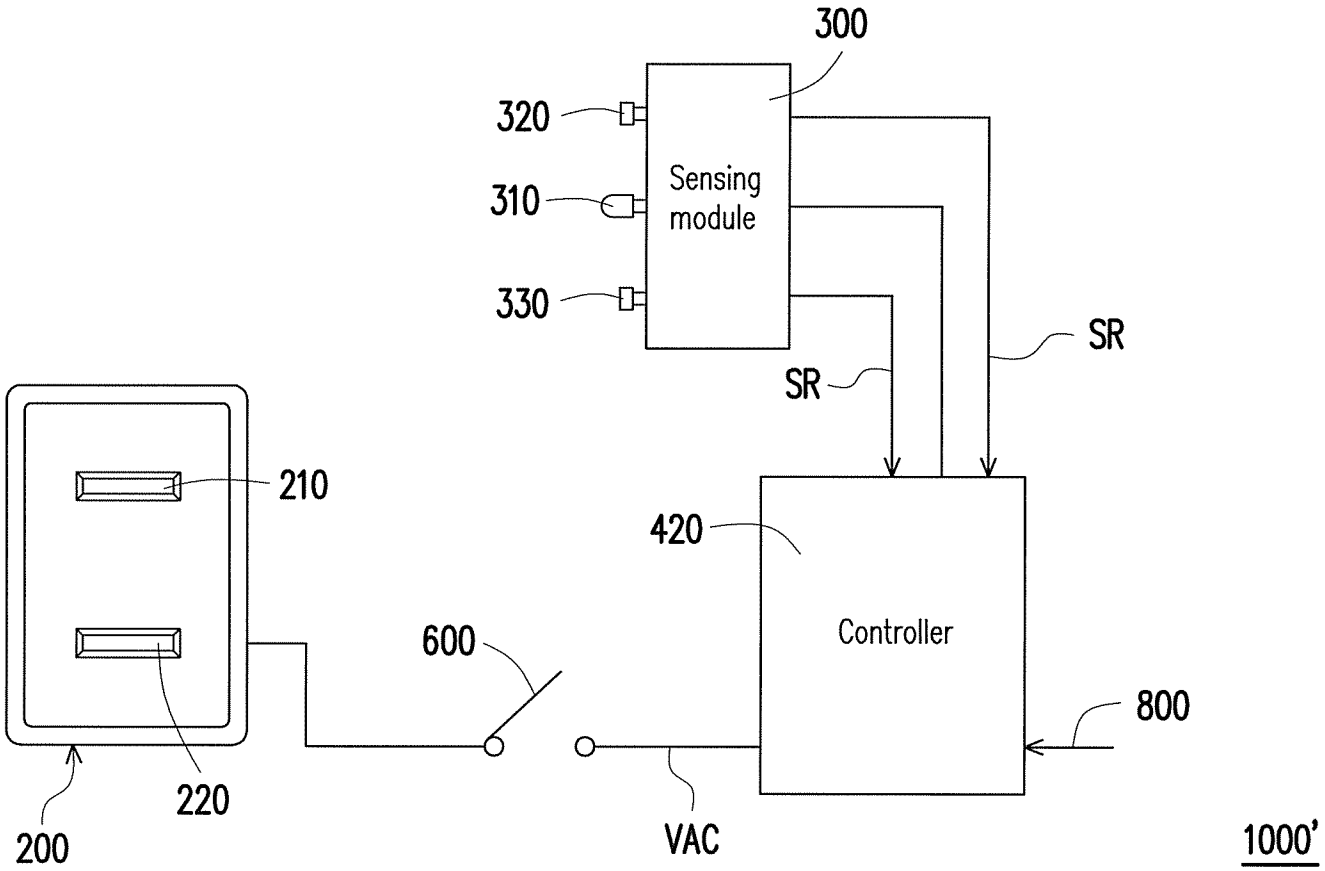
FIG. 12 is a schematic circuit diagram depicting the sparkless socket according to the third embodiment of the invention.
Figure 13:
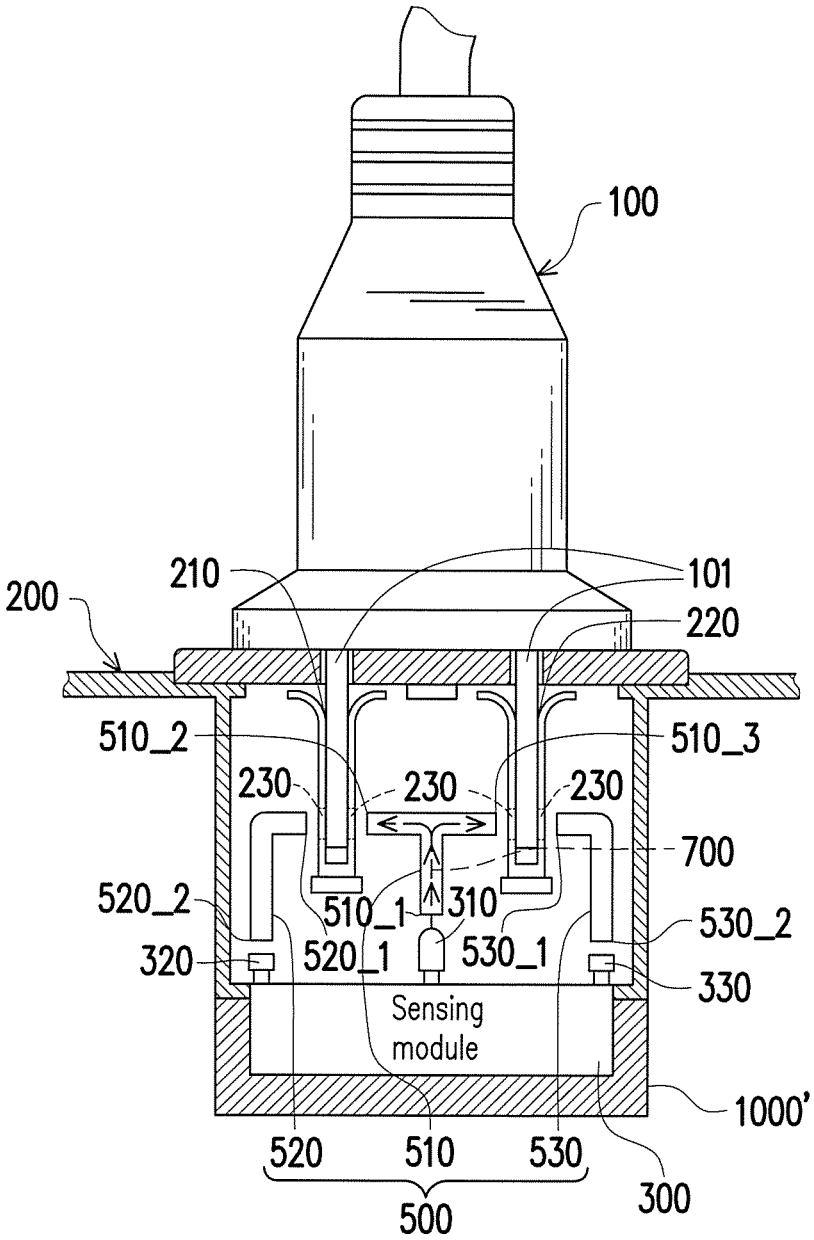
FIG. 13 is a schematic cross-sectional view depicting the sparkless socket combined with the plug according to the third embodiment of the invention.

FIGS. 11-13 are referred to hereinafter. FIGS. 11-13 depict a sparkless socket 1000' according to the third embodiment of the invention. The sparkless socket 1000' is configured to insert a pair of pins 101 of a plug 100. The sparkless socket 1000' includes a socket 200, a sensing module 300, a controller 420, and a switching module 600 (as shown in FIG. 12). A first slot 210 and a second slot 220 are configured in the socket 200. A through hole 230 is configured on a slot wall of each of the first slot 210 and the second slot 220, and the through holes 230 face each other.

An emitter 310, a first receiver 320, and a second receiver 330 are configured on the sensing module 300, wherein the emitter 310 is disposed between the first receiver 320 and the second receiver 330. The emitter 310 is configured to emit infrared light 700 and transmit the infrared light 700 through the through holes 230 to the first receiver 320 and the second receiver 330 respectively via the light guide element module 500.

In the present embodiment, the light guide element module 500 includes a first light guide pillar 510, a second light guide pillar 520, and a third light guide pillar 530. The first light guide pillar 510 is a T-shaped structure, disposed among the first slot 210, the second slot 220, and the emitter 310, and configured to guide the infrared light 700 emitted by the emitter 310. An entrance port 510_1 of the first light guide pillar 510 faces the emitter 310 so as to receive the infrared light 700 emitted by the emitter 310. An exit port 510_2 of the first light guide pillar 510 faces the through hole 230 of the first slot 210, and another exit port 510_3 of the first light guide pillar 510 faces the through hole 230 of the second slot 220. The second light guide pillar 520 is disposed between the first slot 210 and the first receiver 320. An entrance port 520_1 of the second light guide pillar 520 faces the through hole 230 of the first slot 210, and an exit port 520_2 of the second light guide pillar 520 faces the first receiver 320. The third light guide pillar 530 is disposed between the second slot 220 and the second receiver 330. An entrance port 530_1 of the third light guide pillar 530 faces the through hole 230 of the second slot 220, and an exit port 530_2 of the third light guide pillar 530 faces the second receiver 330.

To be specific, the infrared light 700 emitted by the emitter 310 may be transmitted to the first receiver 320 via the first light guide pillar 510, the through hole 230 of the first slot 210, and the second light guide pillar 520. The first receiver 320 may generate a sensing result SR according to whether the infrared light 700 is received. Similarly, the infrared light 700 emitted by the emitter 310 may be transmitted to the second receiver 330 via the first light guide pillar 510, the through hole 230 of the second slot 220, and the third light guide pillar 530. The second receiver 330 may generate a sensing result SR according to whether the infrared light 700 is received.

The controller 420 is coupled to a city power system 800 and the sensing module 300, and configured to receive the sensing result SR from the sensing module 300. The switching module 600 is coupled between the socket 200 and the controller 420. In addition, the switching module 600 receives AC power VAC provided by the city power system 800 from the controller 420, moreover, the switching module 600 is controlled by the controller 420 to transmit the AC power VAC to the socket 200. The controller 420 controls the switching module 600 to be disabled or enabled according to the sensing result SR.

Accordingly, referring to FIG. 11, when the pins 101 of the plug 100 are not inserted or are not completely inserted into the first slot 210 and the second slot 220 of the socket 200, the infrared light 700 emitted by the emitter 310, firstly, passes the T-shaped first light guide pillar 510. After the infrared light 700 enters the first light guide pillar 510, it is incident in both left and right directions and towards the first slot 210 and the second slot 220 respectively. The infrared light 700 which is incident towards the first slot 210 passes through the through hole 230 on the slot wall of the first slot 210 and is transmitted to the first receiver 320 via the second light guide pillar 520. The infrared light 700 which is incident towards the second slot 220 passes through the through hole 230 on the slot wall of the second slot 220 and is transmitted to the second receiver 330 via the third light guide pillar 530. When any one or both of the first receiver 320 and the second receiver 330 sense the infrared light 700, the sensing module 300 transmits the sensing result SR to the controller 420. At this time, the controller 420 may control the switching module 600 to be disabled so that the AC power VAC from the city power system 800 is unable to be provided to the socket 200 through the switching module 600.

Referring to FIG. 13, after the pins 101 of the plug 100 are completely inserted into the first slot 210 and the second slot 220 of the socket 200, the pins 101 of the plug 100 cover the through holes 230 on the slot walls of the first slot 210 and the second slot 220, and thereby blocking the infrared light 700 transmitted via the first light guide pillar 510. As a result, the infrared light 700 is unable to reach the first receiver 320 and the second receiver 330. At this time, the first receiver 320 and the second receiver 330 may transmit the sensing result SR that the infrared light 700 is unable to be sensed to the controller 420. At this time, the controller 420 may then switch the switching module 600 to be enabled so that the AC power VAC from the city power system 800 is able to be transmitted through the switching module 600 to the socket 200, and thereby providing the required load power to the plug 100. By contrast, during power supply operation, once the first receiver 320 or the second receiver 330 senses the infrared light 700 (as shown in FIG. 11), immediately, the controller 420 switches the switching module 600 to be disabled (e.g. within 0.015 seconds or within 15 milliseconds). As a result, sparks are prevented from being generated between the pins 101 and the first slot 210 and the second slot 220, and therefore, from causing dangers.

Figure 14:
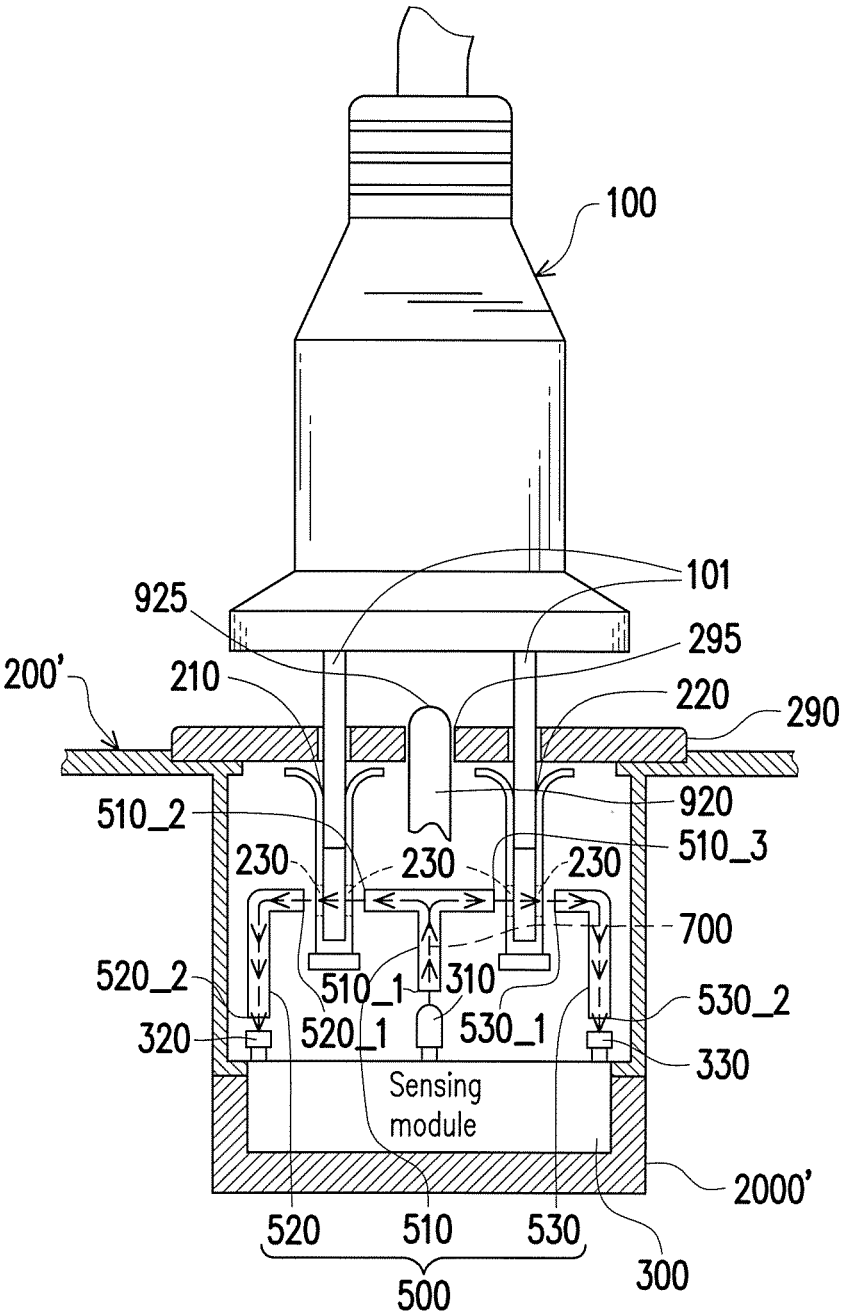
FIG. 14 is a schematic cross-sectional view depicting the sparkless socket combined with the plug along the section line A1-A2 in FIG. 7 according to the fourth embodiment of the invention.
Figure 15:
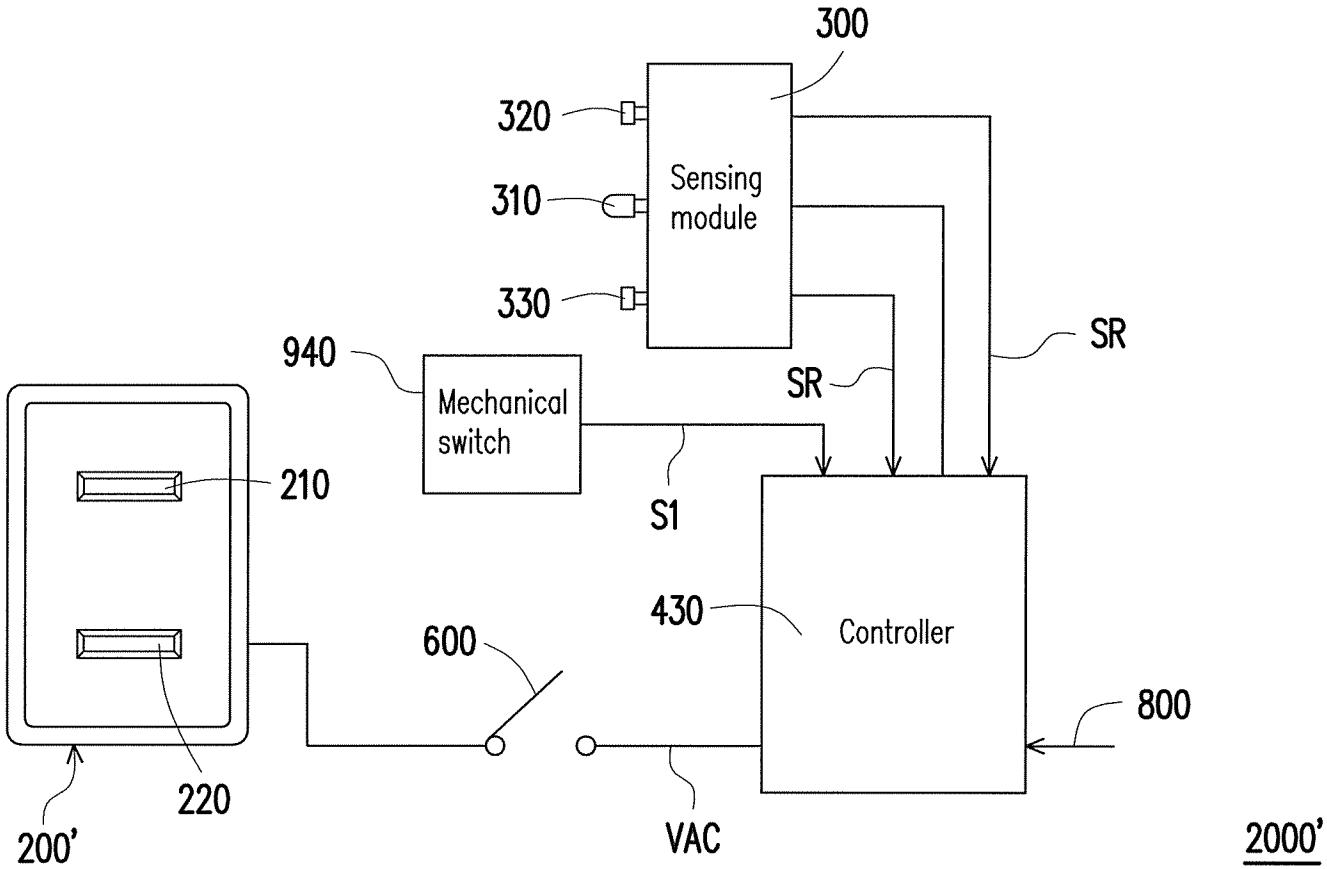
FIG. 15 is a schematic circuit diagram depicting the sparkless socket according to the fourth embodiment of the invention.

FIG. 7 together with FIG. 8B, FIG. 10B, and FIGS. 14-16 are referred to hereinafter. FIG. 7, FIG. 8, FIG. 10B, and FIGS. 14-16 depict a sparkless socket 2000' according to the fourth embodiment of the invention. Similarly, the sparkless socket 2000' of the present embodiment includes a socket 200', a sensing module 300, a controller 430, and a switching module 600 (as shown in FIG. 15). A first slot 210 and a second slot 220 are configured in the socket 200'. A through hole 230 is configured on a slot wall of each of the first slot 210 and the second slot 220, and the through holes 230 face each other. An emitter 310, a first receiver 320, and a second receiver 330 are configured on the sensing module 300, wherein the emitter 310 is disposed between the first receiver 320 and the second receiver 330. The emitter 310 is configured to emit infrared light 700 and transmit the infrared light 700 through the through holes 230 to the first receiver 320 and the second receiver 330 respectively via the light guide element module 500. The operations of the sensing module 300, the emitter 310, the first receiver 320, the second receiver 330, the light guide element module 500, and the switching module 600 of the present embodiment are respectively similar to the operations of the sensing module 300, the emitter 310, the first receiver 320, the second receiver 330, the light guide element module 500, and the switching module 600 shown in FIG. 11-FIG. 13, the details can reference to the related description above and will not be repeated.

In comparison with the embodiment in FIGS. 11-13, the socket 200' of the present embodiment further includes a front wall 290, wherein the front wall 290 has an aperture 295. The aperture 295 is located between the first slot 210 and the second slot 220, as shown in FIG. 7. Moreover, the sparklers socket 2000' further includes a pressing stick 920 and a mechanical switch 940, as shown in FIG. 8B. The pressing stick 920 is disposed in an inner space of the socket 200'. An end of the pressing stick 920 protrudes from the socket 200' via the aperture 295 of the front wall 290 so as to form a protrusion part 925, wherein the material of the pressing stick 920 may be insulation material. The mechanical switch 940 has a control terminal 945. The control terminal 945 of the mechanical switch 940 faces another end of the pressing stick 920. The mechanical switch 940 is controlled by the pressing stick 920 so as to generate a first signal S1 (as shown in FIG. 8B, FIG. 10B, and FIG. 15).

In comparison with the circuit structure of the sparkless socket 1000' shown in FIG. 12, the controller 430 of the sparkless socket 2000' in FIG. 15 is further coupled to the mechanical switch 940 so as to receive the first signal S1. When the controller 430 determines that none of the first receiver 320 and the second receiver 330 receives the infrared light 700 according to the sensing result SR, and determines that the another end of the pressing stick 920 presses the control terminal 945 of the mechanical switch 940 according to the first signal S1, the controller 430 enables the switching module 600, and otherwise, the controller 430 disables the switching module 600. The details related to the operation that the controller 430 determines whether to enable the switching module 600 according to the sensing result SR may reference the above description of the operation of the controller 420 in FIGS. 11-13, and will not be repeated. The details related to the operation that the controller 430 determines whether to enable the switching module 600 according to the first signal S1 may reference the above description of the operation of the controller 410 in FIGS. 7-10B, and will not be repeated.

Figure 16:
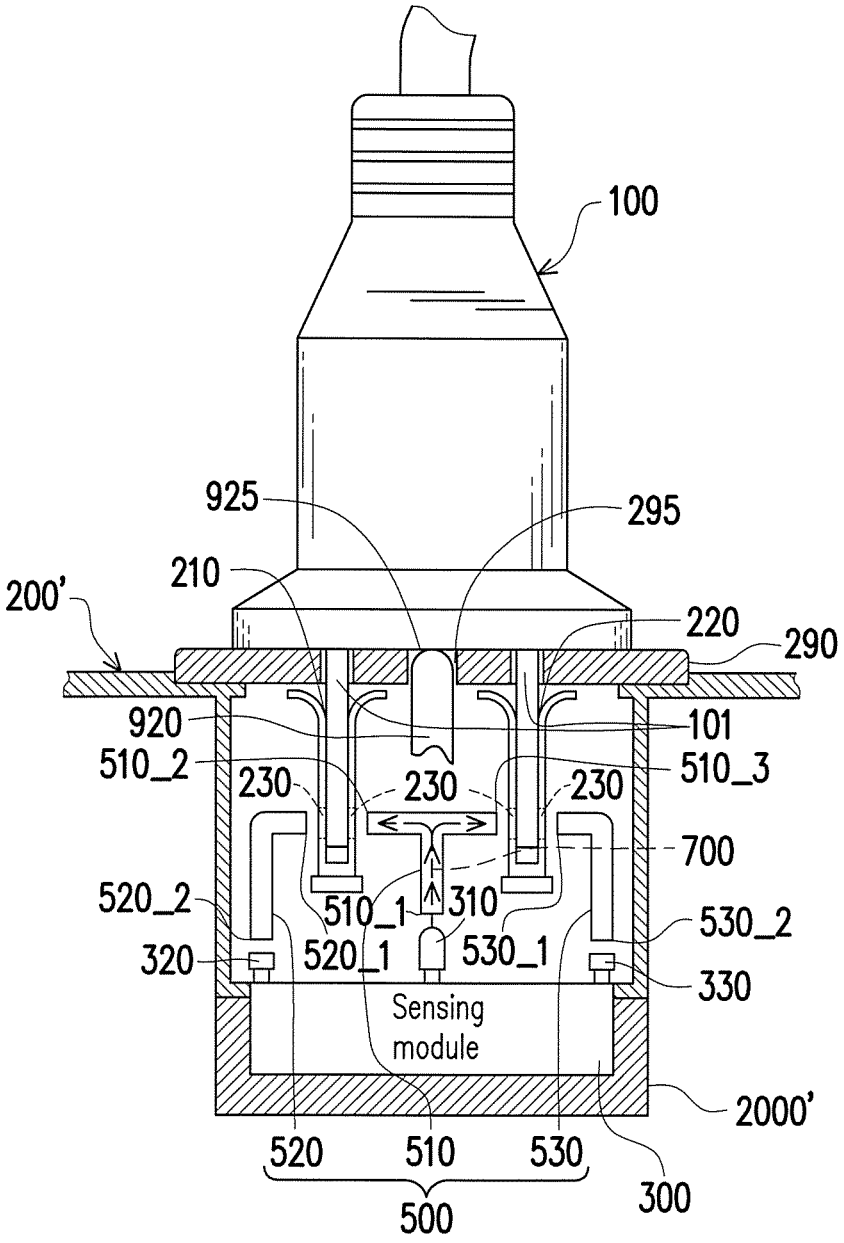
FIG. 16 is a schematic cross-sectional view depicting the sparkless socket combined with the plug along the section line A1-A2 in FIG. 7 according to the fourth embodiment of the invention.

Generally, when the first receiver 320 or the second receiver 330 is able to sense the infrared light 700 or the another end of the pressing stick 920 is not in contact with the control terminal 945 of the mechanical switch 940 (as shown in FIG. 8B and FIG. 14), it represents that the plug 100 is loose and not completely inserted into the first slot 210 and the second slot 220 of the socket 200', or the pins 101 of the plug 100 are pulled out from the first slot 210 and the second slot 220 of the socket 200'. At this time, the controller 430 may switch the switching module 600 to be disabled. As a result, sparks are prevented from being generated between the pins 101 and the first slot 210 and the second slot 220, and therefore, from causing dangers. In contrast, when the first receiver 320 and the second receiver 330 are unable to sense the infrared light 700 and the another end of the pressing stick 920 presses the control terminal 945 of the mechanical switch 940 (as shown in FIG. 10B and FIG. 16), it represents that the pins 10*l* of the plug 100 are completely inserted into the first slot 210 and the second slot 220 of the socket 200'. At this time, the controller 430 may then switch the switching module 600 to be enabled so that the AC power VAC from the city power system 800 is able to be transmitted through the switching module 600 to the socket 200', and thereby providing the required load power to the plug 100.

Figure 17:
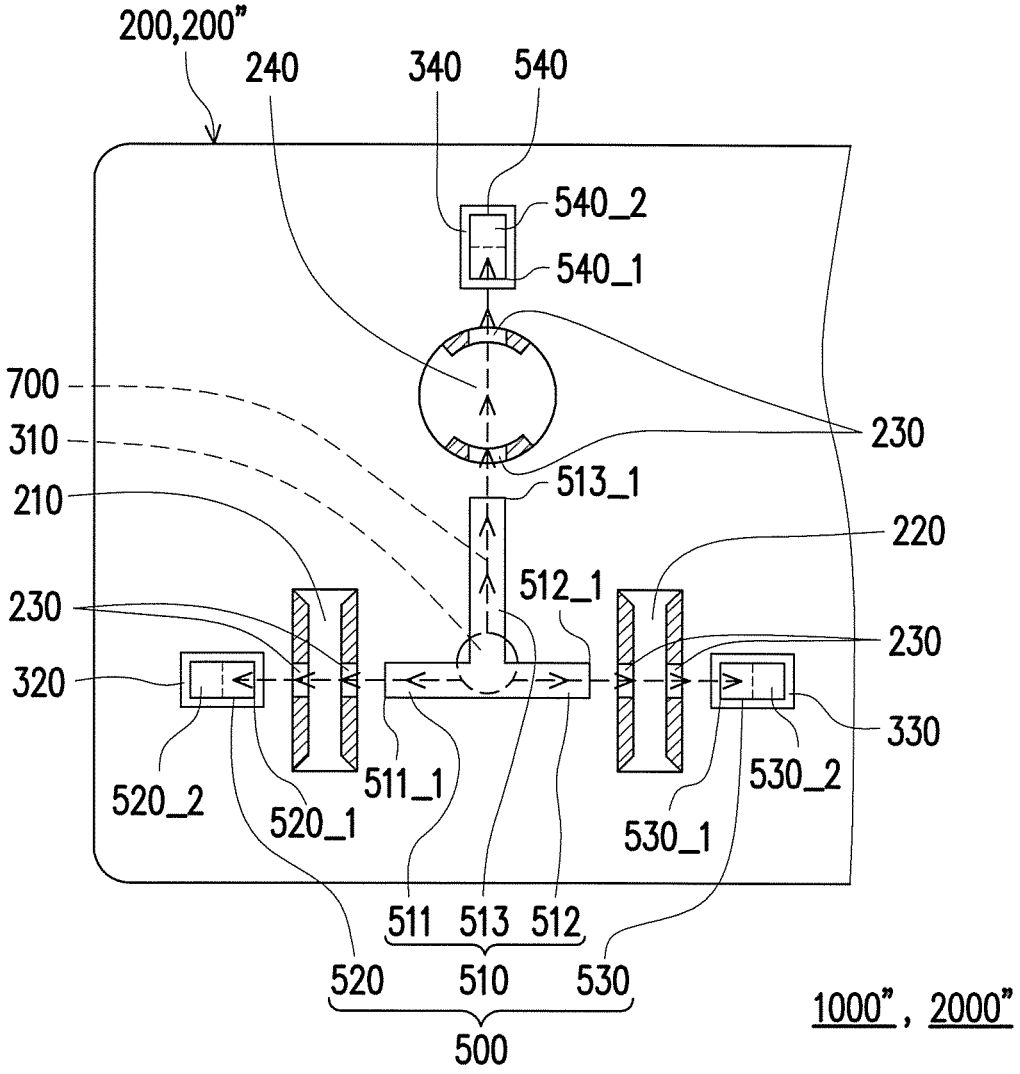
FIG. 17 is a schematic top view depicting a sparkless socket according to the fifth and the sixth embodiments of the invention.
Figure 18:
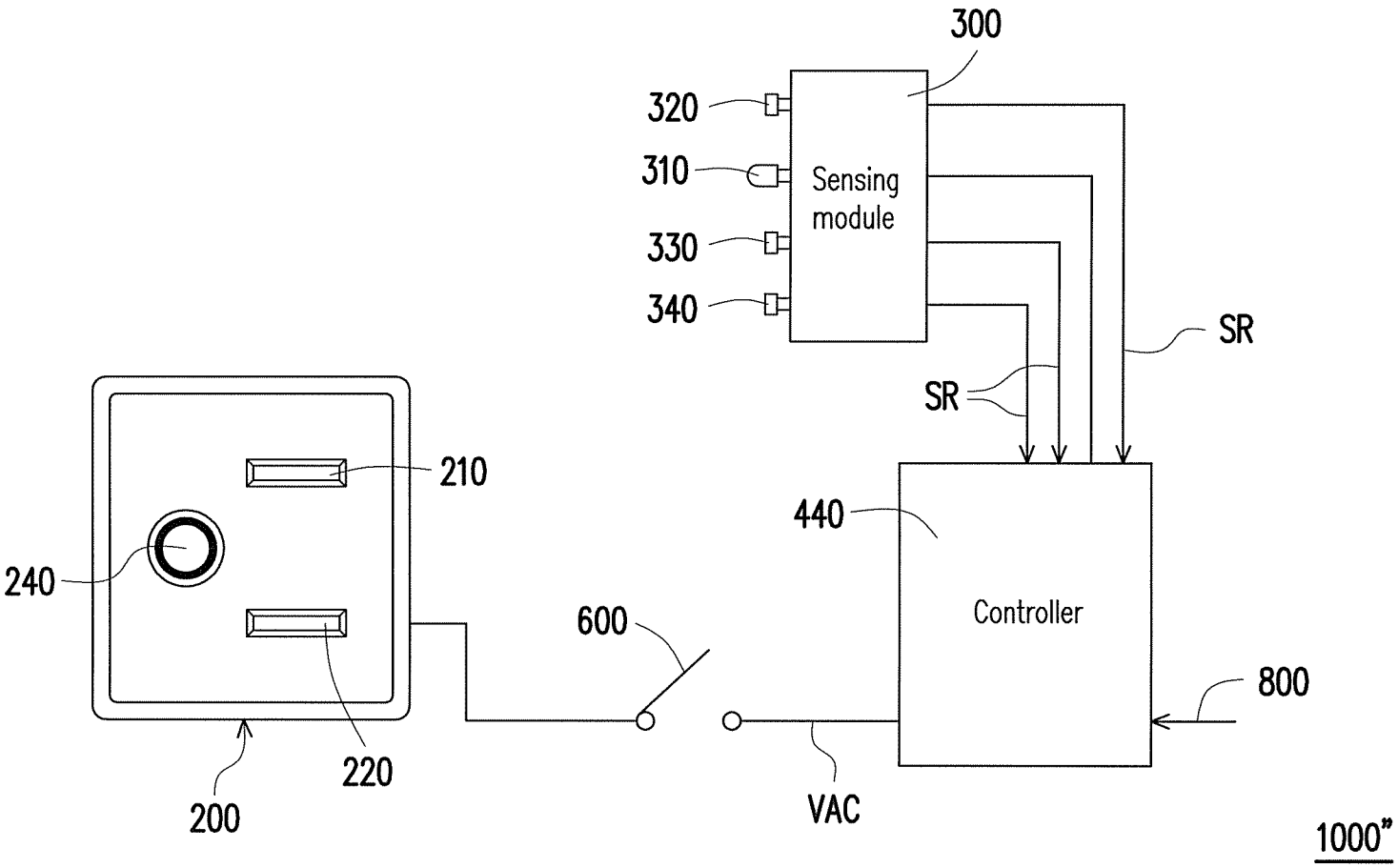
FIG. 18 is a schematic circuit diagram depicting the sparkless socket according to the fifth embodiment of the invention.

FIGS. 17-20 are referred to hereinafter. FIGS. 17-20 depict a sparkless socket 1000" according to the fifth embodiment of the invention. The sparkless socket 1000" is configured to insert three pins 101 of a plug 100. The sparkless socket 1000" includes a socket 200, a sensing module 300, a controller 440, and a switching module 600 (as shown in FIG. 18). The socket 200 includes a first slot 210, a second slot 220, and a third slot 240 at a different direction from the first slot 210 and the second slot 220. A through hole 230 is configured on a slot wall of each of the first slot 210, the second slot 220, and the third slot 240. The light of the same light source may pass through the three through holes 230 at the same time.

An emitter 310, a first receiver 320, a second receiver 330, and a third receiver 340 are configured on the sensing module 300. The emitter 310 is configured to emit infrared light 700 and transmit the infrared light 700 through the through holes 230 to the first receiver 320, the second receiver 330, and the third receiver 340 respectively via the light guide element module 500.

In the present embodiment, the light guide element module 500 includes a first light guide pillar 510, a second light guide pillar 520, a third light guide pillar 530, and a fourth light guide pillar 540. The first light guide pillar 510 is disposed among the first slot 210, the second slot 220, the third slot 240, and the emitter 310, and configured to guide the infrared light 700 emitted by the emitter 310. An entrance port 514_1 of the first light guide pillar 510 faces the emitter 310 so as to receive the infrared light 700 emitted by the emitter 310, three exit ports 511_1, 512_1, and 513_1 of the first light guide pillar 510 faces the through hole 230 of the first slot 210, the through hole 230 of the second slot 220, and the through hole 230 of the third slot 240 respectively.

The second light guide pillar 520 is disposed between the first slot 210 and the first receiver 320. An entrance port 520_1 of the second light guide pillar 520 faces the through hole 230 of the first slot 210, and an exit port 520_2 of the second light guide pillar 520 faces the first receiver 320. The third light guide pillar 530 is disposed between the second slot 220 and the second receiver 330. An entrance port 530_1 of the third light guide pillar 530 faces the through hole 230 of the second slot 220, and an exit port 530_2 of the third light guide pillar 530 faces the second receiver 330. The fourth light guide pillar 540 is disposed between the third slot 240 and the third receiver 340. An entrance port 540_1 of the fourth light guide pillar 540 faces the through hole 230 of the third slot 240, and an exit port 540_2 of the fourth light guide pillar 540 faces the third receiver 340.

Figure 20:
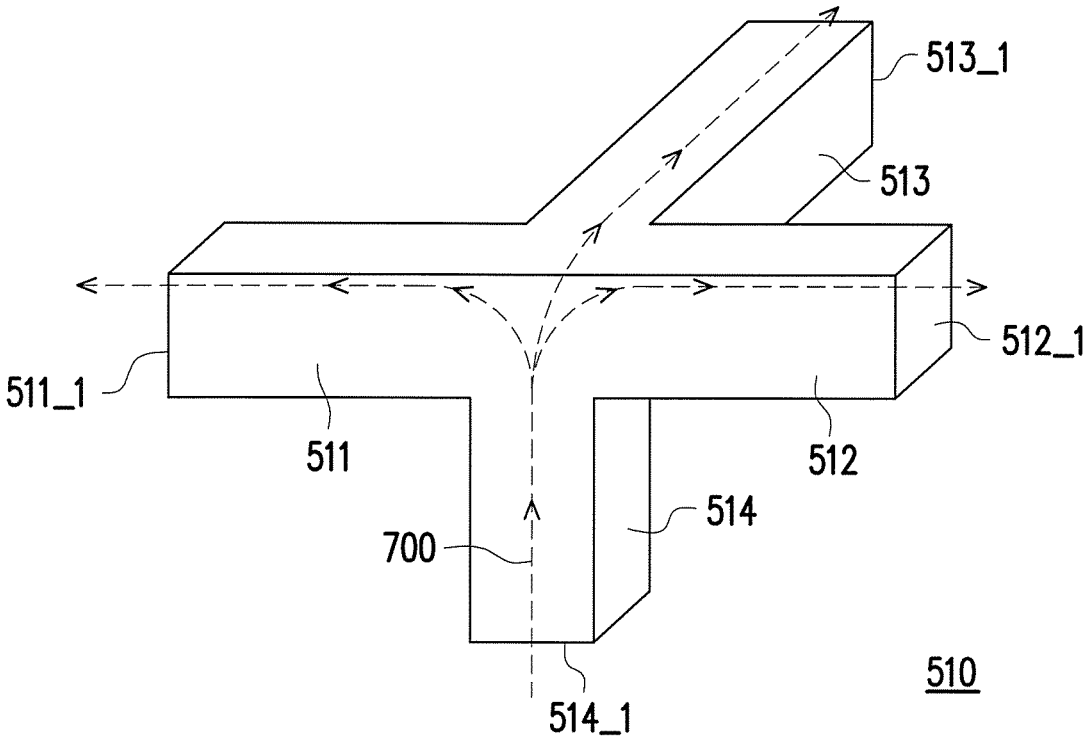
FIG. 20 is a schematic structural three-dimensional view depicting a first light guide pillar of the sparkless socket according to the fifth and the sixth embodiments of the invention.

The first light guide pillar 510 includes a first pin 511, a second pin 512, a third pin 513, and a fourth pin 514. As shown in FIG. 20, the first pin 511, the second pin 512, the third pin 513, and the fourth pin 514 are connected to each other to form a three-dimensional double T-shaped structure. Wherein, the first pin 511, the second pin 512, and the third pin 513 are connected to each other to form a T-shaped structure, and the first pin 511, the second pin 512, and the fourth pin 514 are connected to each other to form another T-shaped structure, furthermore, the third pin 513 and the fourth pin 514 are connected to form an inverted-L structure. The entrance port 514_1 of the first light guide pillar 510 is disposed at the fourth pin 514, and the three exit ports 511_1, 512_1, and 513_1 of the first light guide pillar 510 are respectively disposed at the first pin 511, the second pin 512, and the third pin 513.

Hence, referring to FIG. 17, FIG. 18, and FIG. 20. When the three pins 101 of the plug 100 are not inserted or are not completely inserted into the first slot 210, the second slot 220, and the third slot 240 of the socket 200, the infrared light 700 emitted by the emitter 310, firstly, passes through the fourth pin 514 of the first light guide pillar 510. Next, the infrared light 700 passing through the fourth pin 514 passes through the through holes 230 on the slot walls of the first slot 210, the second slot 220, and the third slot 240 via the first pin 511, the second pin 512, and the third pin 513 respectively. The infrared light 700 passing through the through hole 230 of the first slot 210 is transmitted to the first receiver 320 via the second light guide pillar 520, the infrared light 700 passing through the through hole 230 of the second slot 220 is transmitted to the second receiver 330 via the third light guide pillar 530, and the infrared light 700 passing through the through hole 230 of the third slot 240 is transmitted to the third receiver 340 via the fourth light guide pillar 540. When the first receiver 320, the second receiver 330, and the third receiver 340 sense the infrared light 700, the sensing module 300 transmits the sensing result SR to the controller 440. At this time the controller 440 may control the switching module 600 to be disabled so that the AC power VAC from the city power system 800 is unable to be provided to the socket 200 through the switching module 600.

Figure 19:
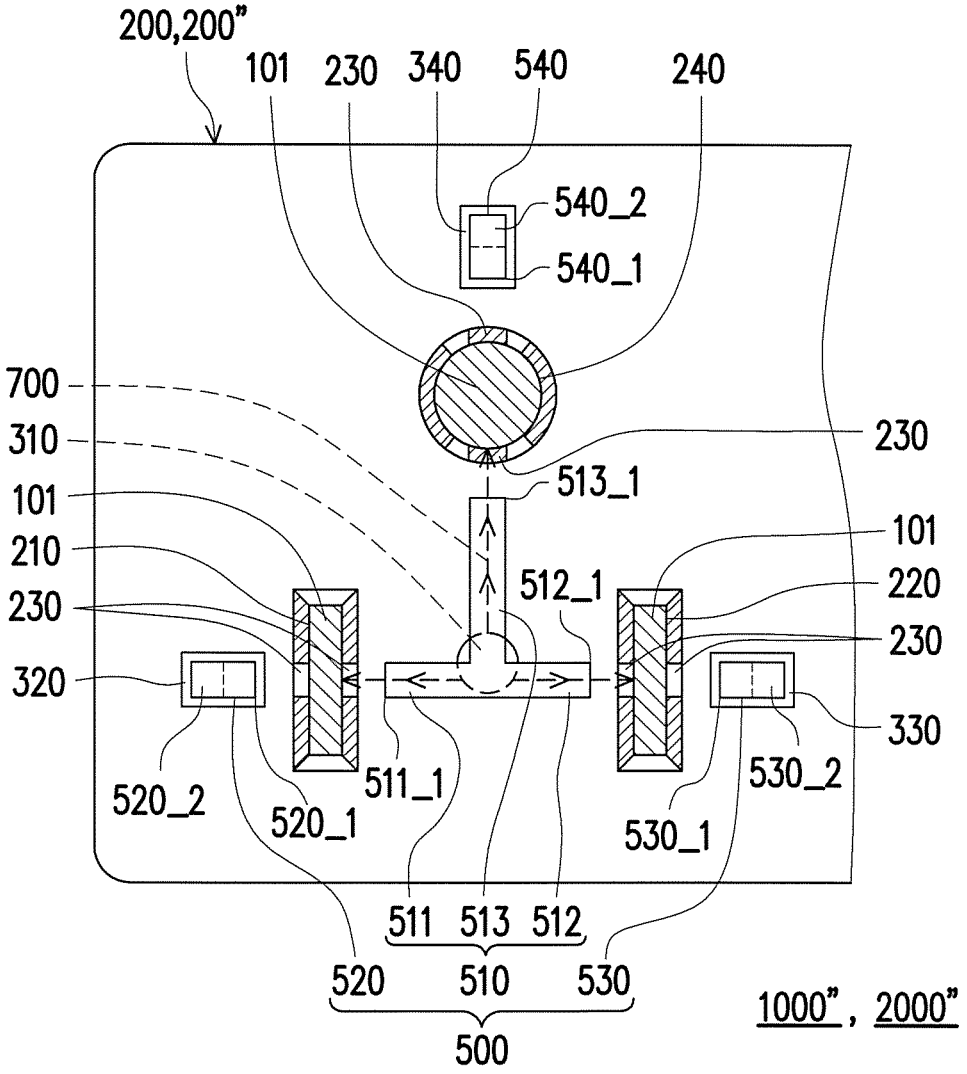
FIG. 19 is a schematic top view depicting the sparkless socket according to the fifth and the sixth embodiments of the invention.

Referring to FIG. 19, after the pins 101 of the plug 100 are completely inserted into the first slot 210, the second slot 220, and the third slot 240 of the socket 200, the pins 101 of the plug 100 cover the through hole 230 of each of the first slot 210, the second slot 220, and the third slot 240, and thereby blocking the infrared light 700 guided by the first light guide pillar 510. As a result, the infrared light 700 is unable to reach the first receiver 320, the second receiver 330, and the third receiver 340. At this time, the first receiver 320, the second receiver 330, and the third receiver 340 may transmit the sensing result SR that the infrared light 700 is unable to be sensed to the controller 440. At this time, the controller 440 may then switch the switching module 600 to be enabled so that the AC power VAC from the city power system 800 is able to be transmitted to the socket 200 via the switching module 600, and thereby providing the required load power to the plug 100. By contrast, during power supply operation, once any of the first receiver 320, the second receiver 330, and the third receiver 340 senses the infrared light 700, immediately, the controller 440 switches the switching module 600 to be disabled (e.g. within 0.015 seconds or within 15 milliseconds). It should be noted here, the third slot 240 is often connected to the ground, and thus it is sometimes not in use. In such instance, extra software or hardware options may be provided for assistances. For example, a software option may be used for setting so as to allow the controller 440 to neglect the sensing result SR from the third receiver 340 when determining whether the pins 101 of the plug 100 are completely inserted into the first slot 210, the second slot 220, and the third slot 240 of the socket 200.

Figure 21:
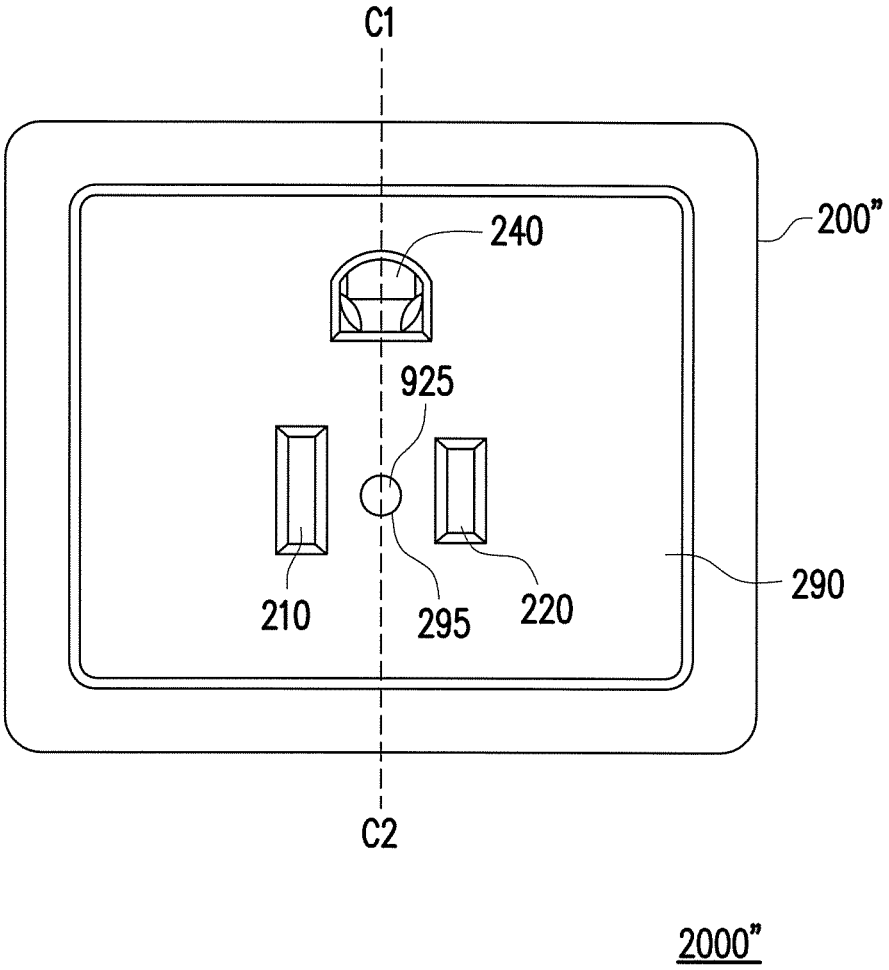
FIG. 21 is a schematic top view depicting the sparkless socket according to the sixth embodiment of the invention.
Figure 22:
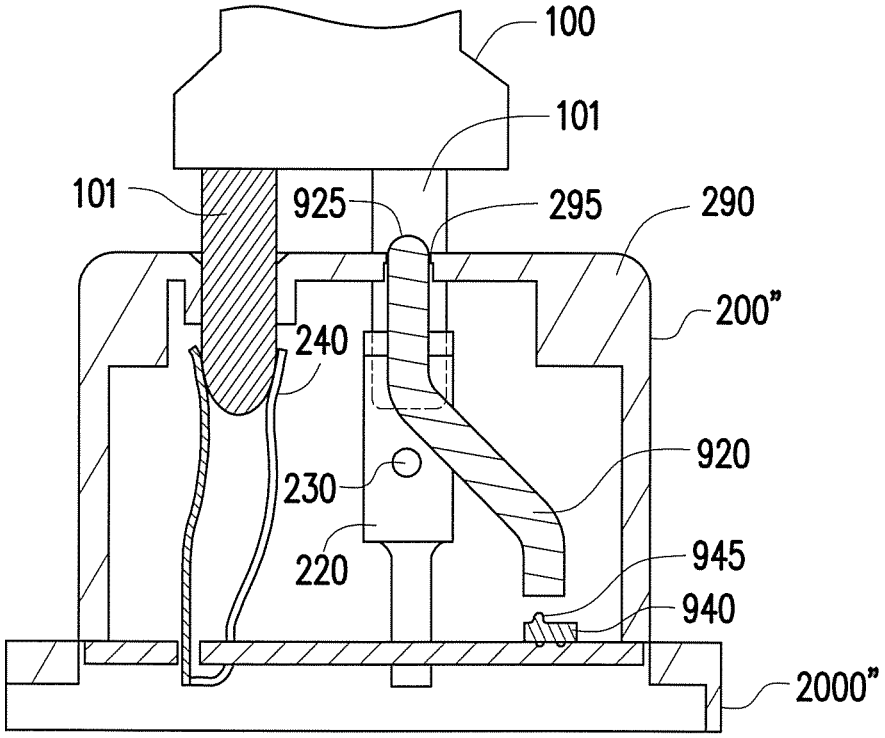
FIG. 22 is a schematic cross-sectional right view depicting the sparkless socket combined with the plug along a section line C1-C2 in FIG. 21 according to the sixth embodiment of the invention.
Figure 23:
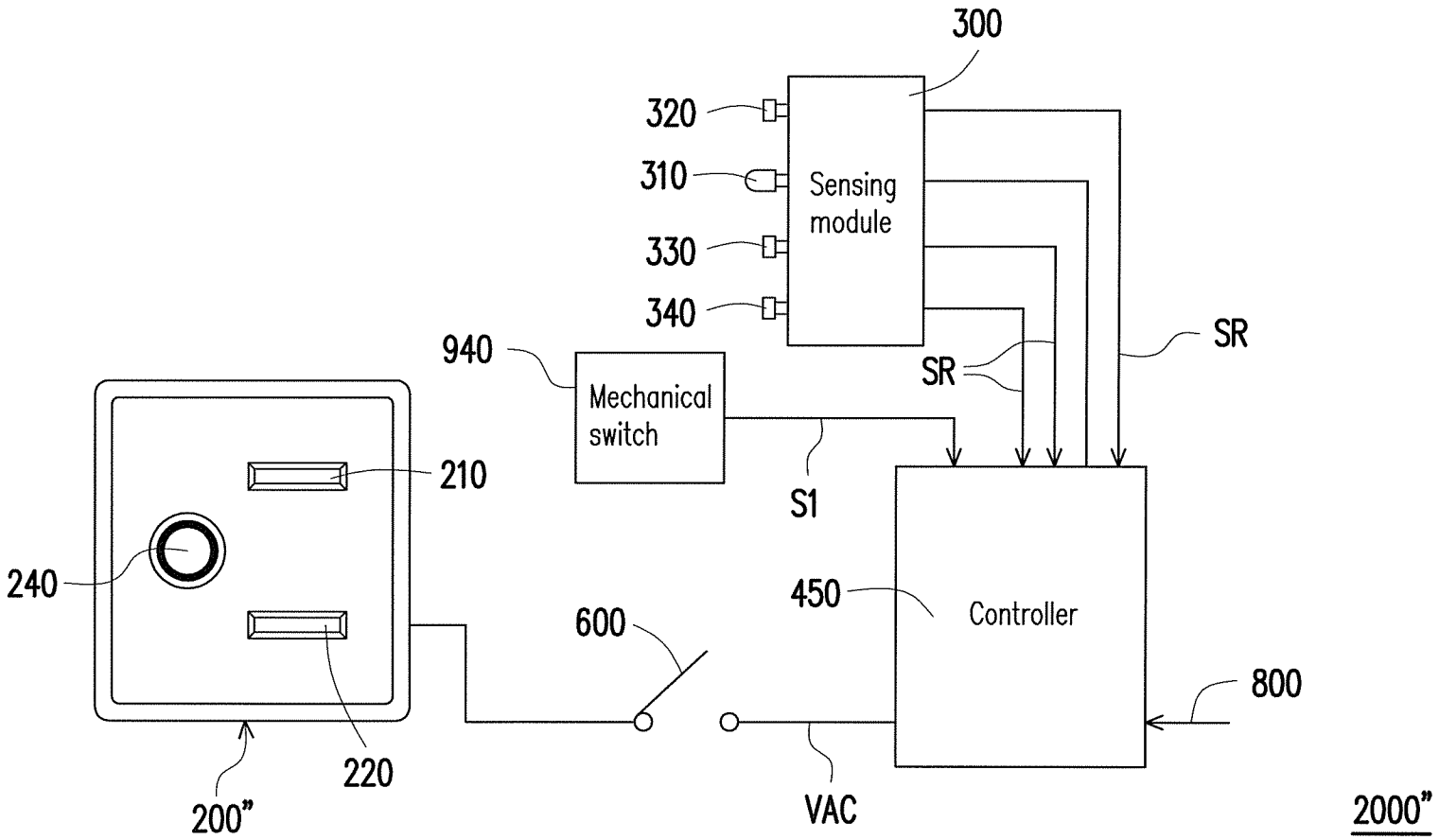
FIG. 23 is a schematic circuit diagram depicting the sparkless socket according to the sixth embodiment of the invention.

FIG. 17 and FIGS. 19-24 are referred to hereinafter. FIG. 17 and FIGS. 19-24 depict the sparkless socket 2000" according to the sixth embodiment of the invention. Similarly, the sparkless socket 2000" of the present embodiment includes a socket 200", a sensing module 300, a controller 450, and a switching module 600 (as shown in FIG. 23). The socket 200" includes a first slot 210, a second slot 220, and a third slot 240 at a different direction from the first slot 210 and the second slot 220. A through hole 230 is configured on a slot wall of each of the first slot 210, the second slot 220, and the third slot 240. The light of the same light source may pass through the three through holes 230 at the same time. An emitter 310, a first receiver 320, a second receiver 330, and a third receiver 340 are configured on the sensing module 300. The emitter 310 is configured to emit infrared light 700 and transmit the infrared light 700 through the through holes 230 to the first receiver 320, the second receiver 330, and the third receiver 340 respectively via the light guide element module 500. The operations of the sensing module 300, the emitter 310, the first receiver 320, the second receiver 330, the third receiver 340, the light guide element module 500, and the switching module 600 of the present embodiment are respectively similar to the operations of the sensing module 300, the emitter 310, the first receiver 320, the second receiver 330, the third receiver 340, the light guide element module 500, and the switching module 600 shown in FIG. 17-FIG. 19, the details can reference to the related description above and will not be repeated.

Figure 24:
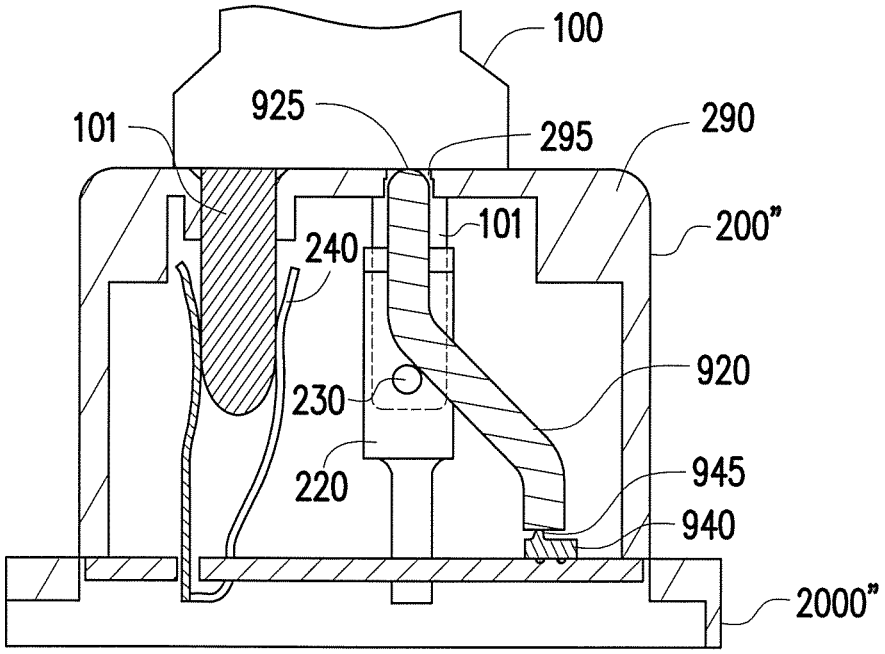
FIG. 24 is a schematic cross-sectional right view depicting the sparkless socket combined with the plug along the section line C1-C2 in FIG. 21 according to the sixth embodiment of the invention.

In comparison with the embodiment in FIGS. 17-19, the socket 200" of the present embodiment further includes a front wall 290, wherein the front wall 290 has an aperture 295. The aperture 295 is located among the first slot 210, the second slot 220, and third slot 240, as shown in FIG. 21. Moreover, the sparkless socket 2000" further includes a pressing stick 920 and a mechanical switch 940, as shown in FIG. 22. The pressing stick 920 is disposed in an inner space of the socket 200". An end of the pressing stick 920 protrudes from the socket 200" via the aperture 295 of the front wall 290 so as to form a protrusion part 925, wherein the material of the pressing stick 920 may be insulation material. The mechanical switch 940 has a control terminal 945. The control terminal 945 of the mechanical switch 940 faces another end of the pressing stick 920. The mechanical switch 940 is controlled by the pressing stick 920 so as to generate a first signal S1 (as shown in FIGS. 22-24).

In comparison with the circuit structure of the sparkless socket 1000" shown in FIG. 18, the controller 450 of the sparkless socket 2000" in FIG. 23 is further coupled to the mechanical switch 940 so as to receive the first signal S1. When the controller 450 determines that none of the first receiver 320, the second receiver 330, and the third receiver 340 receives the infrared light 700 according to the sensing result SR, and determines that the another end of the pressing stick 920 presses the control terminal 945 of the mechanical switch 940 according to the first signal S1, the controller 450 enables the switching module 600, and otherwise, the controller 450 disables the switching module 600. The details related to the operation that the controller 450 determines whether to enable the switching module 600 according to the sensing result SR may reference the above description of the operation of the controller 440 in FIGS. 17-20, and will not be repeated. The details related to the operation that the controller 450 determines whether to enable the switching module 600 according to the first signal S1 may reference the above description of the operation of the controller 410 in FIGS. 7-10B, and will not be repeated.

Generally, when any of the first receiver 320, the second receiver 330, or the third receiver 340 is able to sense the infrared light 700 or the another end of the pressing stick 920 is not in contact with the control terminal 945 of the mechanical switch 940 (as shown in FIG. 17 and FIG. 22), it represents that the plug 100 is loose and not completely inserted into the first slot 210, the second slot 220, and the third slot 240 of the socket 200", or the pins 101 of the plug 100 are pulled out from the first slot 210, the second slot 220, and the third slot 240 of the socket 200". At this time, the controller 450 may switch the switching module 600 to be disabled. As a result, sparks are prevented from being generated between the pins 101 and any of the first slot 210, the second slot 240, or the third slot 240, and therefore, from causing dangers. In contrast, when none of the first receiver 320, the second receiver 330, and the third receiver 340 senses the infrared light 700, and the another end of the pressing stick 920 presses the control terminal 945 of the mechanical switch 940 (as shown in FIG. 19 and FIG. 24), it represents that the pins 101 of the plug 100 are completely inserted into the first slot 210, the second slot 220, and the third slot 240 of the socket 200". At this time, the controller 450 may then switch the switching module 600 to be enabled so that the AC power VAC from the city power system 800 is able to be transmitted to the socket 200" via the switching module 600, and thereby providing the required load power to the plug 100.

Similarly, the third slot 240 is often connected to the ground, and thus it is sometimes not in use. In such instance, extra software or hardware options may be provided for assistances. For example, a software option may be used for setting so as to allow the controller 450 to neglect the sensing result SR from the third receiver 340 when determining whether the pins 101 of the plug 100 are completely inserted into the first slot 210, the second slot 220, and the third slot 240 of the socket 200".

Figure 25:
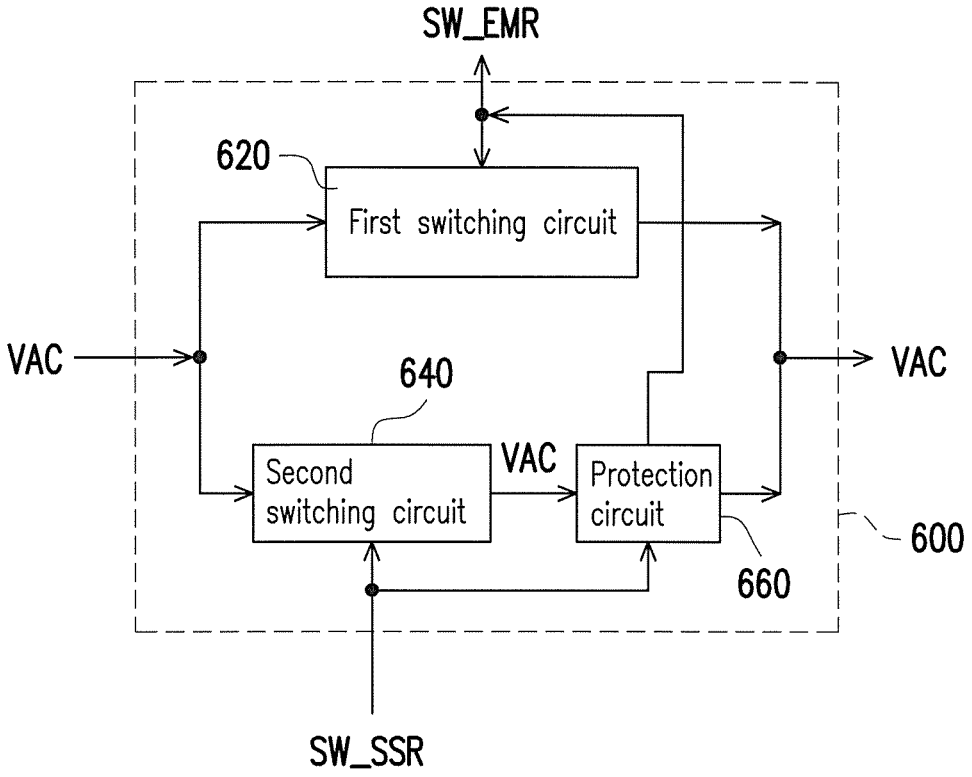
FIG. 25 is a schematic circuit block diagram of a switching module in FIG. 5, FIG. 9, FIG. 12, FIG. 15, FIG. 18, and FIG. 23.

The switching module 600 in the aforesaid embodiments will be described hereafter. Referring to FIG. 5, FIG. 9, FIG. 12, FIG. 15, FIG. 18, FIG. 23 and FIG. 25 simultaneously, FIG. 25 is a schematic circuit block diagram of a switching module 600 in FIG. 5, FIG. 9, FIG. 12, FIG. 15, FIG. 18, and FIG. 23. The switching module 600 includes a first switching circuit 620, a second switching circuit 640, and a protection circuit 660. In an embodiment of the invention, the first switching circuit 620 may include an electromagnetic relay, and the second switching circuit 640 may include a solid state relay, and yet the invention is not limited thereto. In other embodiments of the invention, the first switching circuit 620 may be, for example, a switching circuit which is capable of carrying a higher current load and is less affected by temperature changes, and the second switching circuit 640 may be, for example, a switching circuit with less power consumption and high switching speed.

The first switching circuit 620 is coupled between the controller 400 and the socket 200 so as to receive the AC power VAC of the city power system 800 from the controller 400. The first switching circuit 620 is controlled by a first control signal SW_EMR to transmit the AC power VAC to the socket 200. Wherein the first control signal SW_EMR may be generated by the controller 400 or the protection circuit 660. In other words, the first switching circuit 620 may be controlled by the controller 400 or the protection circuit 660 according to the loading status of the socket 200. More details will be described later on.

The second switching circuit 640 is coupled to the controller 400 so as to receive the AC power VAC from the city power system 800. The protection circuit 660 is coupled between the second switching circuit 640 and the socket 200. As shown in FIG. 25, the second switching circuit 640 and the protection circuit 660 are serially connected, and the second switching circuit 640 and the protection circuit 660 are parallel connected to the first switching circuit 620. Wherein, the second switching circuit 640 is controlled by a second control signal SW_SSR to transmit the AC power VAC through the protection circuit 660 to the socket 200. The protection circuit 660 is controlled by the second control signal SW_SSR to detect the load power of the socket 200 when the second switching circuit 640 is on. Wherein the second control signal SW_SSR is generated by the controller 400. In other words, the controller 400 may simultaneously control to turn on or turn off both the second switching circuit 640 and the protection circuit 660 according to the second control signal SW_SSR.

It is understood that the switching module 600 includes two power transmission channels. One of the power transmission channels receives the AC power VAC from the controller 400 via the first switching circuit 620 and transmits the AC power VAC to the socket 200. The other one of the power transmission channels receives the AC power VAC from the controller 400 via the second switching circuit 640 and the protection circuit 660 and transmits the AC power VAC to the socket 200. That is, the power transmission channels inside the switching module 600 may be set and switched by controlling the on or off of the first switching module 620 and the second switching module 640.

The operation of the switching module 600 will be described in terms of the first embodiment as shown FIG. 3-FIG. 6. The operation of the switching module 600 in other embodiments may be deduced according to the following description. Referring to FIGS. 3-6 and FIG. 25 together. When the pins 101 of the plug 100 of an appliance (not shown) are not inserted or are not completely inserted into the first slot 210 and the second slot 220 of the socket 200, the first receiver 320 senses the infrared light 700. At this time, the controller 400 generates the first control signal SW_EMR and the second control signal SW_SSR to control the first switching circuit 620 and the second switching circuit 640 to be off so that the AC power VAC from the city power system 800 may not be able to be provided to the socket 200 through the switching module 600.

After the pins 101 of the plug 100 of the appliance are completely inserted into the first slot 210 and the second slot 220 of the socket 200, the first receiver 320 transmits the sensing result SR that the infrared light 700 is unable to be sensed to the controller 400. Therefore, the controller 400 may then switch the first switching circuit 620 or the second switching circuit 640 in the switching module 600 to be on so that the AC power VAC from the city power system 800 is able to be transmitted to the socket 200 through one of the power transmission channels of the switching module 600, and thereby providing the required load power to the plug 100 (i.e. the appliance).

Furthermore, the controller 400 may also detect the power requirement of the appliance on the socket 200 and the load power of the appliance. The controller 400 may switch the first switching circuit 620 and the second switching circuit 640 of the switching module 600 according to the detected load power of the socket 200.

In general, when the electromagnetic relay of the first switching circuit 620 is under-loaded, its power consumption is relatively higher than that of the solid state relay of the second switching circuit 640. The electromagnetic relay of the first switching circuit 620 even continues consuming power while it is standing by (i.e. not loaded). On the other hand, the power consumption of the solid state relay of the second switching circuit 640 is proportional to the load current. Hence, while the solid state relay is standing by (i.e. not loaded, the load current is approximately 0 A) or under-loaded (e.g. the load current is less than 0.5 A), it possesses a characteristics of zero power consumption or low power consumption and thus is able to effectively reduce electricity consumption. The solid state relay also has a higher switching speed.

Under the aforesaid condition, when the load power of the socket 200 is less than a power-saving threshold TH2, the controller 400 turns on the second switching circuit 640 and the protection circuit 660 and turns off the first switching circuit 620 so as to make the sparkless socket 1000 operate in a low power mode. Conversely, when the load power of the socket 200 is continuously greater than the power-saving threshold TH2 for a predetermined time period, the controller 400 turns on the first switching circuit 620 and turns off the second switching circuit 640 and protection circuit 660 so as to make the sparkless socket 1000 operate in a high power mode. The aforesaid power-saving threshold TH2 may be set according to actual applications or design requirements.

In general, after the user finishes using the appliance, he/she would often only turn off the appliance instead of unplugging the plug 100 of the appliance from the socket 200. Since the pins 101 of the plug 100 are still completely inserted in the first slot 210 and the second slot 220 of the socket 200, the infrared light 700 guided by the first light guide pillar 510 does not reach the first receiver 320. Hence, the controller 400 keeps the switching module 600 enabled. In other words, the AC power VAC from the city power system 800 is continuously provided to the socket 200. At this time, since the switch of the appliance inserted in the socket 200 (i.e. the load) is off, the load power of the socket 200 detected by the controller 400 should be 0 W. After the controller 400 determines that the load power of the socket 200 is continuously less than the power-saving threshold TH2 for a predetermined time period, the controller 400 turns on the second switching circuit 640 and the protection circuit 660 and turns off the first switching circuit 620 so as to make the sparkless socket 1000 operate in a low power mode.

Under such condition, if the appliance inserted in the socket 200 is a high power appliance (e.g. air conditioner, oven, or hair dryer), when the user turns on the appliance, an extreme current would instantaneously flow from the city power system 800, through the controller 400 and the switching module 600, and to the appliance coupled to the socket 200. Since the sparkless socket 1000 operates under the low power mode (i.e. the second switching circuit 640 is on and the first switching circuit 620 is off), if the extreme current exceeds a rated current of the solid state relay of the second switching circuit 640 (i.e. the second switching circuit 640 is over-loaded), the solid state relay of the second switching circuit 640 may be damaged. Besides, when the second switching circuit 640 is over-loaded, the controller 400 mostly may not be able to switch the switching module 600 instantly (e.g. within milliseconds). As a result, the risk of damaging the solid state relay of the second switching circuit 640 may be greatly increased. In order to avoid such scenario, the protection circuit 660 may perform overload protection on the second switching circuit 640.

To be specific, when the protection circuit 660 detects that the load power of the socket 200 is greater than an overload threshold TH1, it may generate the first control signal SW_EMR instantly (e.g. in milliseconds) to turn on the first switching circuit 620. Since the second switching circuit 640 is parallel connected to the first switching circuit 620 and the first switching circuit 620 is capable of carrying a higher current load, the first switching circuit 620 may divide overload currents when the second switching circuit 640 is over-loaded (i.e. the overload power is greater than the overload threshold TH1) so as to perform overload protection on the second switching circuit 640. The aforesaid overload threshold TH1 may be set according to actual applications or design requirements, where the power-saving threshold TH2 is normally less than the overload threshold TH1.

Moreover, the protection circuit 660 may provide notification for the controller 400 through the first control signal SW_EMR. When the controller 400 determines that the first switching circuit 620 is turned on by the protection circuit 660 according to the first control signal SW_EMR, the controller 400 generates the second control signal SW_SSR to turn off the second switching circuit 640 and the protection circuit 660 and controls the first switching circuit 620 to remain being on. Regarding the detailed implementation of the first switching circuit 620, the second switching circuit 640, and the protection circuit 660 may refer to U.S. patent application Ser. No. 14/640,024, titled "POWER TRANSMISSION APPARATUS WITH OVER-LOADING PROTECTION AND POWER-SAVING MECHANISM".

In summary, the sparkless socket of the embodiments of the invention, before a plug of an appliance being completely inserted into the socket, allows the controller to disable the switching module because the infrared light emitted by the emitter may pass through the through holes and reach the receiver or the another end of the pressing stick is not in contact with the mechanical switch. In contrast, after the plug of the appliance is completely inserted into the socket, the through holes are covered by the plug so that the infrared light emitted by the emitter is blocked and unable to be transmitted to the receiver and the protrusion part is controlled by the plug to make the another end of the pressing stick press the mechanical switch. At this time, the controller is able to switch the switching module to be enabled, so as to provide AC power to the socket. As a result, sparks are prevented from being generated at the moment when the pins of the plug are being in contact with or being pulled out from the socket, so as to enhance the electricity safety.

Although the present invention has been described with reference to the above embodiments, it will be apparent to one of the ordinary skill in the art that modifications to the described embodiments may be made without departing from the spirit of the invention. Accordingly, the scope of the invention is defined by the attached claims not by the above detailed descriptions.

What is claimed is:

1. A sparkless socket, configured to be plugged with a pair of pins of a plug, comprising:

a socket, wherein a first slot and a second slot are configured in the socket, a through hole is configured on a slot wall of each of the first slot and the second slot, and the through holes face each other;

a sensing module, comprising:

an emitter, configured to emit infrared light; and a first receiver, configured to receive the infrared light via a light guide element module and at least one of the through holes and generate a first sensing result accordingly;

a controller, coupled to the sensing module, configured to receive the first sensing result, and connected to a city power system; and a switching module, coupled between the socket and the controller to receive an alternating-current (AC) power from the city power system, and controlled by the controller to transmit the AC power to the socket, wherein when the controller determines that the first receiver does not receive the infrared light according to the first sensing result, the controller enables the switching module and the AC power is provided to the socket through the switching module, wherein after the switching module is enabled by the controller, once the controller determines that the first receiver receives the infrared light based on the first sensing result, the controller disables the switching module within 0.015 seconds, such that sparks are prevented from being generated between the pair of pins and the first slot and the second slot of the socket, wherein the switching module comprises:

an electromagnetic relay, coupled between the controller and the socket to receive the AC power from the city power system, and controlled by a first control signal to transmit the AC power to the socket;

a solid state relay, coupled to the controller to receive the AC power; and a protection circuit, coupled between the solid state relay and the socket, wherein the solid state relay is controlled by a second control signal and transmits the AC power through the protection circuit to the socket, wherein the protection circuit is controlled by the second control signal to detect a load power of the socket while the solid state relay is on, if the solid state relay is over-loaded, the protection circuit generates the first control signal to turn on the electromagnetic relay to protect the solid state relay which is on and the AC power is still provided to the socket by the switching module after the electromagnetic relay is turned on for protecting the solid state relay.

2. The sparkless socket as recited in claim 1, wherein the socket further comprises a front wall, the front wall has an aperture, and the aperture is located between the first slot and the second slot, wherein the sparkless socket further comprises:

a pressing stick, disposed in an inner space of the socket, an end of the pressing stick protrudes from the socket via the aperture of the front wall to form a protrusion part; and a mechanical switch, wherein the mechanical switch has a control terminal, the control terminal of the mechanical switch faces another end of the pressing stick, the mechanical switch is controlled by the pressing stick to generate a first signal, wherein the controller is further coupled to the mechanical switch to receive the first signal, when the controller determines that the first receiver does not receive the infrared light according to the first sensing result and determines that the another end of the pressing stick presses the control terminal of the mechanical switch according to the first signal, the controller enables the switching module, and otherwise, the controller disables the switching module.

3. The sparkless socket as recited in claim 2, wherein:

the another end of the pressing stick is not in contact with the control terminal of the mechanical switch when the plug does not touch the protrusion part; and the plug presses the protrusion part to cause the another end of the pressing stick to press the control terminal of the mechanical switch after the pair of pins of the plug are completely inserted into the first slot and the second slot of the socket.

4. The sparkless socket according to claim 1, wherein the sensing module further comprises:

a second receiver, configured to receive the infrared light via the light guide element module and one of the through holes, and generate a second sensing result accordingly, wherein the first receiver is configured to receive the infrared light via the light guide element module and another one of the through holes, and generate the first sensing result accordingly, wherein when the controller determines that none of the first receiver and the second receiver receives the infrared light according to the first sensing result and the second sensing result, the controller enables the switching module, and otherwise, the controller disables the switching module.

5. The sparkless socket as recited in claim 4, wherein the socket further comprises a front wall, the front wall has an aperture, and the aperture is located between the first slot and the second slot, wherein the sparkless socket further comprises:

a pressing stick, disposed in an inner space of the socket, an end of the pressing stick protrudes from the socket via the aperture of the front wall to form a protrusion part; and a mechanical switch, wherein the mechanical switch has a control terminal, the control terminal of the mechanical switch faces another end of the pressing stick, the mechanical switch is controlled by the pressing stick to generate a first signal, wherein the controller is further coupled to the mechanical switch to receive the first signal, when the controller determines that none of the first receiver and the second receiver receives the infrared light according to the first sensing result and the second sensing result and determines that the another end of the pressing stick presses the control terminal of the mechanical switch according to the first signal, the controller enables the switching module, and otherwise, the controller disables the switching module.

6. The sparkless socket as recited in claim 5, wherein:

when the plug does not touch the protrusion part, the another end of the pressing stick is not in contact with the control terminal of the mechanical switch; and after the pair of pins of the plug are completely inserted into the first slot and the second slot of the socket, the plug presses the protrusion part to cause the another end of the pressing stick to press the control terminal of the mechanical switch.

7. The sparkless socket as recited in claim 4, wherein the emitter is disposed between the first receiver and the second receiver, and the light guide element module comprises:

a first light guide pillar, disposed among the first slot, the second slot, and the emitter, and configured to guide the infrared light emitted by the emitter, wherein an entrance of the first light guide pillar faces the emitter to receive the infrared light emitted by the emitter, an exit of the first light guide pillar faces the through hole of the first slot, and another exit of the first light guide pillar faces the through hole of the second slot;

a second light guide pillar, disposed between the first slot and the first receiver, wherein an entrance of the second light guide pillar faces the through hole of the first slot, and an exit of the second light guide pillar faces the first receiver; and a third light guide pillar, disposed between the second slot and the second receiver, wherein an entrance of the third light guide pillar faces the through hole of the second slot, and an exit of the third light guide pillar faces the second receiver.

8. The sparkless socket as recited in claim 7, wherein:

when the pair of pins of the plug is not inserted or not completely inserted into the first slot and the second slot, the infrared light emitted by the emitter is transmitted to the first receiver via the first light guide pillar, the through hole of the first slot, and the second light guide pillar sequentially, and the infrared light emitted by the emitter is transmitted to the second receiver via the first light guide pillar, the through hole of the second slot, and the third light guide pillar sequentially; and after the pair of pins of the plug is completely inserted into the first slot and the second slot, the pair of pins of the plug covers the through hole of the first slot and the through hole of the second slot to block the infrared light guided by the first light guide pillar.

9. The sparkless socket as recited in claim 1, wherein the light guide element module comprises:

a first light guide pillar, disposed between the first slot and the emitter, and configured to guide the infrared light emitted by the emitter, wherein an entrance of the first light guide pillar faces the emitter to receive the infrared light emitted by the emitter, and an exit of the first light guide pillar faces the through hole of the first slot; and a second light guide pillar, disposed between the second slot and the first receiver, wherein an entrance of the second light guide pillar faces the through hole of the second slot, and an exit of the second light guide pillar faces the first receiver, wherein the first slot and the second slot are disposed between the first light guide pillar and the second light guide pillar.

10. The sparkless socket as recited in claim 9, wherein:

when the pair of pins of the plug is not inserted or not completely inserted into the first slot and the second slot, the infrared light emitted by the emitter is transmitted to the first receiver via the first light guide pillar, the through hole of the first slot, the through hole of the second slot, and the second light guide pillar sequentially; and after the pair of pins of the plug is completely inserted into the first slot and the second slot, the pair of pins of the plug covers the through hole of the first slot and the through hole of the second slot to block the infrared light guided by the first light guide pillar.

11. The sparkless socket as recited in claim 1, wherein the controller receives the first control signal, and when the controller determines that the electromagnetic relay is turned on according to the first control signal, the controller controls the electromagnetic relay to remain being on, and the controller generates the second control signal to turn off the solid state relay and the protection circuit.

12. The sparkless socket as recited in claim 4, configured to be plugged with the pair of pins and an extra pin of the plug, wherein a third slot at a different direction from the first slot and the second slot is further configured in the socket, and a through hole is configured on a slot wall of the third slot, wherein the sensing module further comprises:

a third receiver, configured to receive the infrared light via the light guide element module and the through hole of the third slot and generate a third sensing result accordingly;

wherein when the controller determines that none of the first receiver, the second receiver, and the third receiver receives the infrared light according to the first sensing result, the second sensing result, and the third sensing result, the controller enables the switching module, and otherwise, the controller disables the switching module.

13. The sparkless socket as recited in claim 12, wherein the socket further comprises a front wall, the front wall has an aperture, the aperture is located among the first slot, the second slot, and the third slot, wherein the sparkless socket further comprises:

a pressing stick, disposed in an inner space of the socket, an end of the pressing stick protrudes from the socket via the aperture of the front wall to form a protrusion part; and a mechanical switch, wherein the mechanical switch has a control terminal, the control terminal of the mechanical switch faces another end of the pressing stick, the mechanical switch is controlled by the pressing stick to generate a first signal, wherein the controller is further coupled to the mechanical switch to receive the first signal, when the controller determines that none of the first receiver, the second receiver, and the third receiver receives the infrared light according to the first sensing result, the second sensing result, and the third sensing result and determines that the another end of the pressing stick presses the control terminal of the mechanical switch according to the first signal, the controller enables the switching module, and otherwise, the controller disables the switching module.

14. The sparkless socket as recited in claim 13, wherein:

when the plug does not touch the protrusion part, the another end of the pressing stick is not in contact with the control terminal of the mechanical switch; and after the pins of the plug are completely inserted into the first slot, the second slot, and the third slot of the socket, the plug presses the protrusion part to cause the another end of the pressing stick to press the control terminal of the mechanical switch.

15. The sparkless socket as recited in claim 12, wherein the light guide element module comprises:

a first light guide pillar, disposed among the first slot, the second slot, the third slot, and the emitter, and configured to guide the infrared light emitted by the emitter, wherein an entrance of the first light guide pillar faces the emitter to receive the infrared light emitted by the emitter, and three exits of the first light guide pillar faces the through hole of the first slot, the through hole of the second slot, and the through hole of the third slot respectively;

a second light guide pillar, disposed between the first slot and the first receiver, wherein an entrance of the second light guide pillar faces the through hole of the first slot, and an exit of the second light guide pillar faces the first receiver;

a third light guide pillar, disposed between the second slot and the second receiver, wherein an entrance of the third light guide pillar faces the through hole of the second slot, and an exit of the third light guide pillar faces the second receiver; and a fourth light guide pillar, disposed between the third slot and the third receiver, wherein an entrance of the fourth light guide pillar faces the through hole of the third slot, and an exit of the fourth light guide pillar faces the third receiver.

16. The sparkless socket as recited in claim 15, wherein:

the first light guide pillar comprises a first pin, a second pin, a third pin, and a fourth pin connected with each other, and the first pin, the second pin, the third pin, and the fourth pin form a three-dimensional double T-shaped structure, wherein the first pin, the second pin, and the third pin are connected with each other to form a T-shaped structure, wherein the first pin, the second pin, and the fourth pin are connected with each other to form another T-shaped structure, and wherein the third pin and the fourth pin are connected with each other to form an inverted-L structure, and wherein the entrance of the first light guide pillar is disposed at the fourth pin, and the three exits of the first light guide pillar are respectively disposed at the first pin, the second pin, and the third pin.

17. The sparkless socket as recited in claim 15, wherein:

when the three pins of the plug are not inserted or not completely inserted into the first slot, the second slot, and the third slot of the socket, the infrared light emitted by the emitter is transmitted to the first receiver via the first light guide pillar, the through hole of the first slot, and the second light guide pillar sequentially, the infrared light emitted by the emitter is transmitted to the second receiver via the first light guide pillar, the through hole of the second slot, and the third light guide pillar sequentially, and the infrared light emitted by the emitter is transmitted to the third receiver via the first light guide pillar, the through hole of the third slot, and the fourth light guide pillar sequentially; and after the three pins of the plug are completely inserted into the first slot, the second slot, and the third slot of the socket, the three pins of the plug cover the through hole of the first slot, the through hole of the second slot, and the through hole of the third slot to block the infrared light guided by the first light guide pillar.

18. The sparkless socket as recited in claim 12, wherein the controller receives the first control signal, and when the controller determines that the electromagnetic relay is turned on according to the first control signal, the controller controls the electromagnetic relay to remain being on, and the controller generates the second control signal to turn off the solid state relay and the protection circuit.

* * * * *